US012059053B2

(12) United States Patent
Aslani et al.

(10) Patent No.: US 12,059,053 B2
(45) **Date of Patent: *Aug. 13, 2024**

(54) ENCASED STROBEL WITH CUSHIONING MEMBER AND METHOD OF MANUFACTURING AN ARTICLE OF FOOTWEAR

(71) Applicant: NIKE, Inc., Beaverton, OR (US)

(72) Inventors: Koosha Aslani, Tigard, OR (US); Juliana Flores Baza, Hillsboro, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/366,141

(22) Filed: Aug. 7, 2023

(65) Prior Publication Data

US 2023/0371648 A1 Nov. 23, 2023

Related U.S. Application Data

(62) Division of application No. 17/193,438, filed on Mar. 5, 2021, now Pat. No. 11,758,975.

(60) Provisional application No. 63/000,034, filed on Mar. 26, 2020.

(51) Int. Cl.
*A43B 13/20* (2006.01)
*A43B 13/12* (2006.01)

(52) U.S. Cl.
CPC ..... *A43B 13/20* (2013.01); *A43B 13/127* (2013.01)

(58) Field of Classification Search
CPC ..... A43B 3/0036; A43B 13/12; A43B 13/125; A43B 13/127; A43B 13/18; A43B 13/181; A43B 13/184; A43B 13/186; A43B 13/187; A43B 13/188; A43B 13/189; A43B 13/20; A43B 13/203; A43B 13/206
USPC ..... 36/28, 29, 35 B, 35 R
See application file for complete search history.

(56) References Cited

U.S. PATENT DOCUMENTS

2018/0213886 A1 8/2018 Connell et al.

*Primary Examiner* — Jameson D Collier
*Assistant Examiner* — Matthew R Marchewka
(74) *Attorney, Agent, or Firm* — Quinn IP Law

(57) ABSTRACT

A strobel for an article of footwear may include a casing having a peripheral flange and defining a cavity. The strobel may also include at least one cushioning member disposed in the cavity. An exterior surface of the casing facing away from the cavity may be a foot contact surface of the strobel and the peripheral flange may be configured for connection to a lower perimeter of a footwear upper of an article of footwear. A method of manufacturing an article of footwear includes securing a peripheral flange of the casing to a lower perimeter of an upper, the upper and the strobel defining a foot-receiving void of the article of footwear, the strobel having at least one cushioning member.

20 Claims, 26 Drawing Sheets

ENCASED STROBEL WITH CUSHIONING MEMBER AND METHOD OF MANUFACTURING AN ARTICLE OF FOOTWEAR

CROSS-REFERENCE TO RELATED APPLICATIONS

This application is a divisional of U.S. Nonprovisional patent application Ser. No. 17/193,438, filed Mar. 5, 2021, which claims the benefit of priority to U.S. Provisional Application No. 63/000,034 filed Mar. 26, 2020, and each of which is hereby incorporated by reference in its entirety.

TECHNICAL FIELD

The present disclosure generally relates to a strobel for an article of footwear that includes a casing and a cushioning member in the casing, an article of footwear including the strobel, and a method of manufacturing the article of footwear including the strobel.

BACKGROUND

Footwear sole structures are often configured with a midsole configured to provide cushioning and energy return. Footwear uppers are often lasted with a strobel that closes a lower portion of the upper and overlies the midsole. In order to tightly fit the upper to the last, the strobel is generally a relatively inelastic component. Traditional strobels thus do not serve as cushioning components, and in fact may change the desired cushioning dynamic and reduce the cushioning effect of the underlying midsole as felt by the wearer. Some traditional strobels may be somewhat stiff and may be generally harder than the underlying midsole. An insole, sometimes referred to as a sockliner, is often disposed over the strobel in the foot-receiving void of the upper in order to provide cushioning above the relatively hard strobel. The insole may be removable or fixed to the upper or sole structure. This adds to the weight and expense of the footwear.

BRIEF DESCRIPTION OF THE DRAWINGS

The drawings described herein are for illustrative purposes only, are schematic in nature, and are intended to be exemplary rather than to limit the scope of the disclosure.

DESCRIPTION

The present disclosure generally relates to strobels, articles of footwear, and methods of manufacturing articles of footwear that address the limitations of traditional strobel and footwear construction by effectively configuring the strobel to function as a cushioning component in addition to closing the bottom portion of the upper. The various strobels, articles of footwear, and methods of manufacturing described herein alleviate the need for any insole or other structure configured to overlie the strobel in the foot-receiving void.

In an implementation, a strobel for an article of footwear may include a casing having a peripheral flange and defining a cavity. The strobel may also include at least one cushioning member disposed in the cavity. An exterior surface of the casing facing away from the cavity may be a foot contact surface of the strobel and the peripheral flange may be configured for connection to a lower perimeter of a footwear upper of an article of footwear.

In one configuration, an article of footwear may include an upper and a strobel. The strobel may include a casing having a peripheral flange and defining a cavity. The strobel may further include at least one cushioning member disposed in the cavity. A lower perimeter of the upper may be secured to the peripheral flange of the strobel, the upper and the strobel defining a foot-receiving void of the article of footwear. An exterior surface of the casing facing away from the cavity may be a foot contact surface of the strobel within the foot-receiving void. The article of footwear may thus be characterized by the absence of an insole.

In an aspect, a method of manufacturing an article of footwear may include securing a peripheral flange of a casing of a strobel to a lower perimeter of an upper, the upper and the strobel defining a foot-receiving void of the article of footwear. The strobel may have at least one cushioning member, and the casing may include at least one of a polymeric material or a textile material and may define a cavity with the at least one cushioning member disposed in the cavity. An exterior surface of the casing facing away from the cavity may be a foot contact surface of the strobel within the foot-receiving void, the article of footwear thus characterized by the absence of an insole.

The above features and advantages and other features and advantages of the present teachings are readily apparent from the following detailed description of the modes for carrying out the present teachings when taken in connection with the accompanying drawings.

Figure 1:
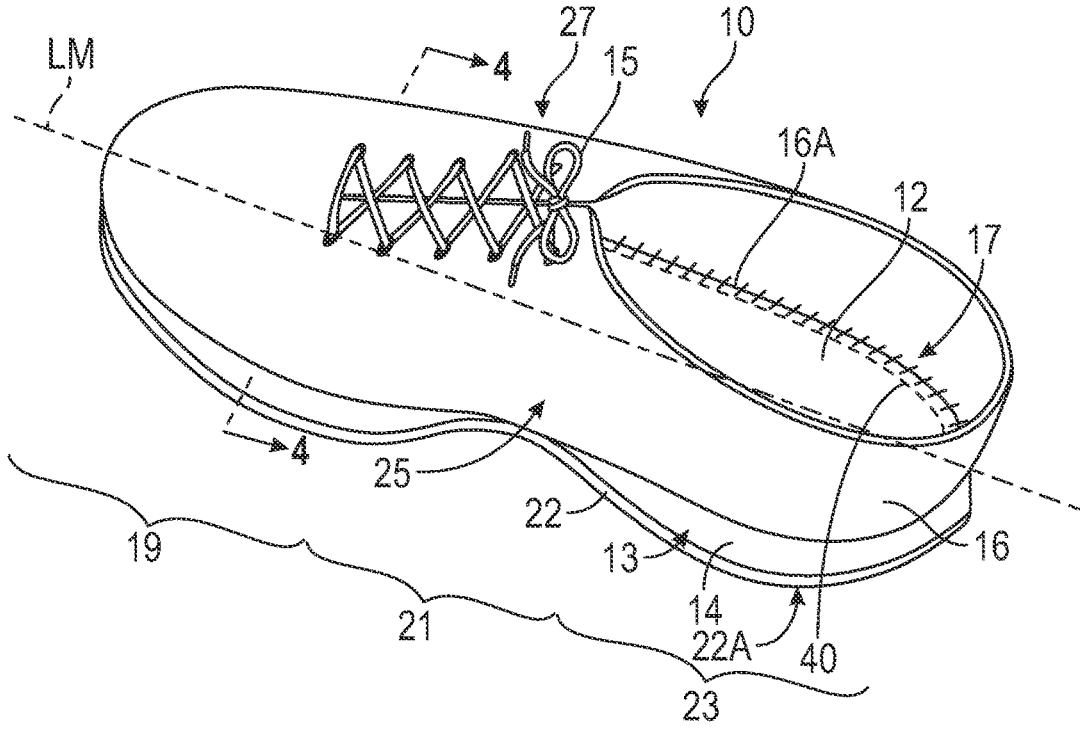
FIG. 1 is a perspective illustration of an article of footwear.

Referring to the drawings, wherein like reference numbers refer to like components, FIG. 1 shows an article of footwear 10 that includes one example of a strobel 12 that provides the advantages described herein, such as by providing better cushioning, including increasing the cushioning effect of the underlying sole structure 13, including a midsole 14, as felt by the wearer without an insole while still affording efficient manufacturability.

Figure 4:
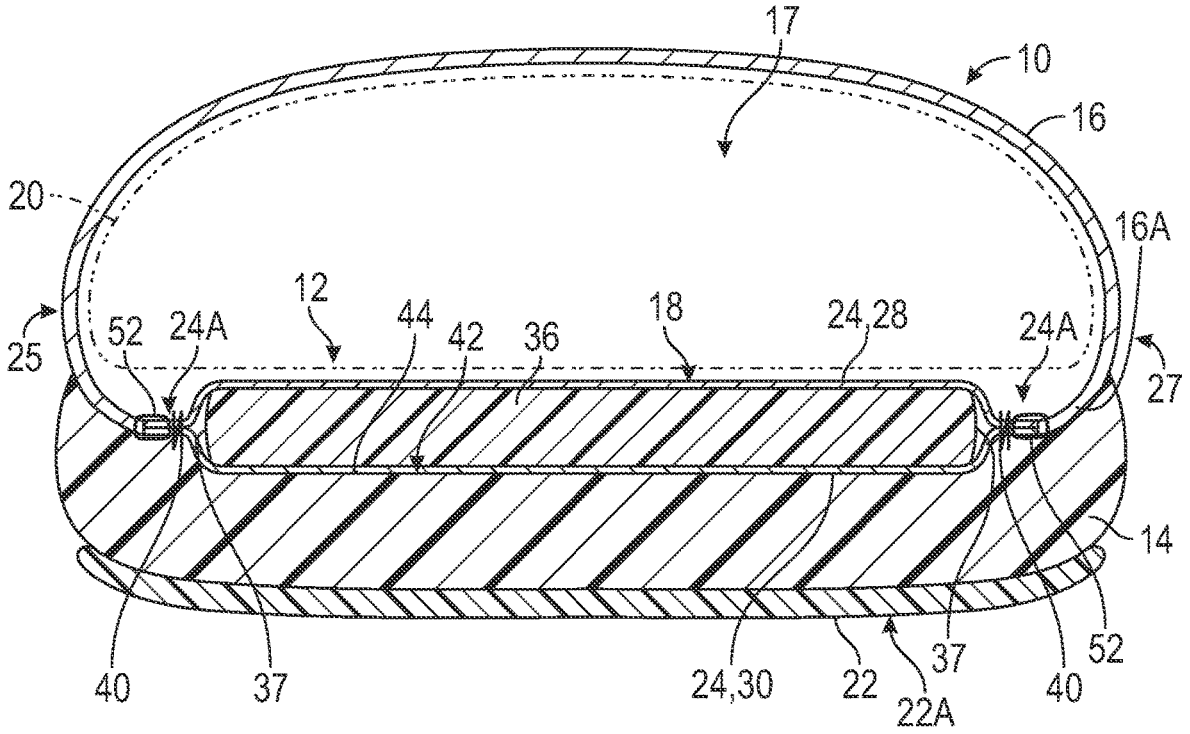
FIG. 4 is a cross-sectional illustration of the article of footwear of FIG. 1 taken at lines 4-4 in FIG. 1.

The article of footwear 10 has an upper 16 with a lower perimeter 16A to which the strobel 12 is secured so that an exterior surface 18 of the strobel 12 is a foot contact surface within a foot-receiving void 17 of the upper 16, as best shown in FIG. 4 in which a foot 20 is shown resting directly on the foot contact surface 18, without an insole. Accordingly, the exterior surface 18 is also referred to herein as the foot contact surface. A sock or other foot covering may or may not be worn on the foot. Accordingly, the cushioning effect of the strobel 12 and the midsole 14 is provided to the foot 20 without an intervening traditional strobel or insole. The article of footwear 10 is characterized by the absence of an insole. An outsole 22 is shown underlying the midsole 14. In some examples, a unisole which serves as a combination midsole and outsole may be used in place of the midsole 14 and outsole 22.

The upper 16 and strobel 12 together form the foot-receiving void 17 configured to receive a foot 20. The upper 16 may be a variety of materials, such as leather, textiles, polymers, cotton, foam, composites, etc., and is shown in FIG. 1 with a lace 15 for tightening the upper 16 around a foot 20. The upper 16 may instead be lace-less.

The footwear 10 illustrated herein is depicted as an athletic shoe configured for sports or for wear as a leisure shoe, but the footwear 10 is not limited to athletic or leisure shoes. The footwear 10 including its components described herein may be an athletic shoe, a leisure shoe, a dress shoe, a work shoe, a sandal, a slipper, a boot, or any other category of footwear.

As indicated in FIG. 1, the footwear 10 may be divided into a forefoot region 19, a midfoot region 21, and a heel region 23, which are also the forefoot region, the midfoot region, and the heel region, respectively, of the strobel 12, the sole structure 13, and the upper 16. The forefoot region 19 generally includes portions of the article of footwear 10 corresponding with the toes and the joints connecting the metatarsals with the phalanges of the foot 20. The midfoot region 21 generally includes portions of the article of footwear 10 corresponding with the arch area and instep of the foot 20, and the heel region 23 corresponds with rear portions of the foot 20, including the calcaneus bone. The forefoot region 19, the midfoot region 21, and the heel region 23 are not intended to demarcate precise areas of the footwear 10 but are instead intended to represent general areas of the footwear 10 to aid in the following discussion.

The footwear 10 has a medial side 25 and a lateral side 27. The medial side 25 and the lateral side 27 extend through each of the forefoot region 19, the midfoot region 21, and the heel region 23, each falling on an opposite side of a longitudinal midline (LM) of the article of footwear 10, as is understood by those skilled in the art. The longitudinal midline (LM) extends along a longitudinal axis of the article of footwear 10. The medial side 25 is thus considered opposite to the lateral side 27. The medial side 25 and the lateral side 27 may be used in reference to a component of the footwear 10 or to the footwear 10 as a whole.

The midsole 14 may be a foamed polymeric material and may be at least partially a polyurethane (PU) foam, and/or a polyurethane ethylene-vinyl acetate (EVA) foam, and may include heat-expanded and molded EVA foam pellets. The midsole 14 may comprise PEBAX® thermoplastic elastomer foam and may be sold under the tradename ZOOMX by NIKE, Inc. The midsole 14 may be any of these foamed polymeric materials, and may have a different compressive stiffness than the cushioning member 36 of the strobel 12 described herein.

The outsole 22 may be a more durable material than the midsole 14. For example, the outsole 22 may include a rubber material that may be a natural rubber, or a synthetic rubber, or a combination of both. Examples of types of rubbers that may be included in the outsole 22 include butadiene rubber, styrene-butadiene (SBR) rubber, butyl rubber, isoprene rubber, urethane rubber, nitrile rubber, neoprene rubber, ethylene propylene diene monomer (EPDM) rubber, ethylene-propylene rubber, urethane rubber, polynorbornene rubber, methyl methacrylate butadiene styrene (MBS) rubber, styrene ethylene butylene (SEBS) rubber, silicone rubber, and/or mixtures thereof. The rubber included in the outsole 22 may be a virgin material, a regrind material, and/or mixtures thereof. The outsole 22 establishes the ground-engaging surface 22A of the article of footwear 10 and may be one-piece or may be several discrete outsole components. In one example, the outsole 22 may be formed from a wear-resistant material that may be textured to impart traction.

Figure 2:
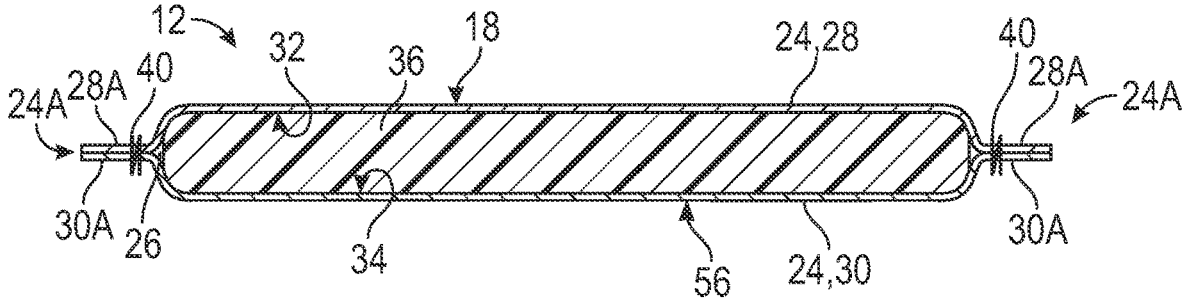
FIG. 2 is a cross-sectional illustration of a strobel included in the article of footwear, the strobel including a casing and a cushioning member.

Referring to FIG. 2, the strobel 12 includes a casing 24 having a peripheral flange 24A and defining a cavity 26. In the embodiment shown, the cavity 26 is an enclosed cavity. The peripheral flange 24A is an integral part of the casing 24 as described herein. More specifically, the casing 24 includes a top sheet 28 and a bottom sheet 30. The peripheral flange 24A includes a periphery 28A of the top sheet 28 as well as a periphery 30A of the bottom sheet 30 joined to the periphery of the top sheet 28 to define the peripheral flange 24A and enclose the cavity 26.

In the example shown, the peripheral flange 24A extends around and defines the entire perimeter (e.g., outwardly surrounding the cavity 26) generally in an X-Y plane of the strobel 12, where the Z plane is the height of the strobel 12 when viewed as in FIG. 2 (e.g., from the exterior surface 18 of the top sheet 28 of the casing 24 to the exterior surface 56 of the bottom sheet 30 of the casing 24). The exterior surface 56 is also referred to as the bottom exterior surface 56 of the casing 24. The cushioning member 36 may be "full length" extending in the forefoot region 19, the midfoot region 21, and the heel region 23, or may extend only in one of the regions, 19, 21, or 23, or may extend in any two adjacent ones of the regions 19, 21, and 23. In the example shown, the cushioning member 36 is full length, and the peripheral flange 24A extends around the forefoot region 19, the midfoot region 21, and the heel region 23 of the strobel 12.

The cavity 26 is defined between an inner surface 32 of the top sheet 28 and an inner surface 34 of the bottom sheet 30. The exterior surface 18 of the casing 24 facing away from the cavity 26 is the foot contact surface of the strobel 12 within the foot-receiving void 17 as the article of footwear 10 characterized by the absence of an insole.

Figure 3:
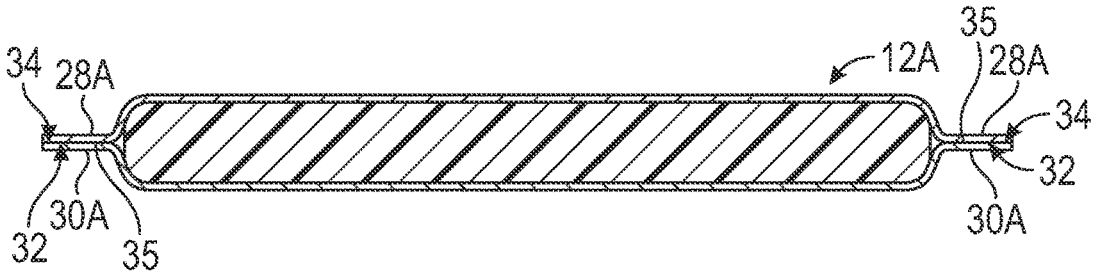
FIG. 3 is a cross-sectional illustration of another example of a strobel for the article of footwear.

The strobel 12 also includes a cushioning member 36 disposed in the cavity 26 entirely inward of the peripheral flange 24A. The cushioning member 36 may be any material configured to resiliently deform under a dynamic compressive load, reducing in thickness (e.g., in the vertical direction in FIGS. 2-4) under the load and resiliently returning to a steady state thickness (e.g., a thickness related to the steady state load supported on the footwear 10, such as when supporting the weight of a stationary wearer). In the embodiment of FIGS. 2-4, the cushioning member 36 comprises foam, such as but not limited to a polyurethane (PU) foam, a polyurethane ethylene-vinyl acetate (EVA) foam, heat-expanded and molded EVA foam pellets, or PEBAX® thermoplastic elastomer foam sold under the tradename ZOOMX by NIKE, Inc.

Each of the top sheet 28 and the bottom sheet 30 includes a polymeric material or a textile material or a combination thereof that is generally stretchable and flexible to enable the sheets 28, 30 to closely conform to the outer surface of the cushioning member 36. FIG. 2 shows a slight space between the sheets 28, 30 and the cushioning member 36 at the sides of the cushioning member 36. However, a vacuum may be applied to completely conform the flexible, relatively elastic, and resiliently stretchable sheets 28, 30 to the exterior surface of the cushioning member 36, eliminating any gaps between the cushioning member 36 and the inner surfaces of the sheets 28, 30 in the cavity 26.

When the cushioning member 36 resiliently compresses under dynamic loads applied to the article of footwear 10 by the wearer, the casing 24 will flex in accordance with the cushioning member 36 without inhibiting the resilient deformation or energy return thereof. For example, the top sheet 28 may include a textile material and the bottom sheet 30 may include a thermoplastic polyurethane material, or the top sheet 28 may include a thermoplastic polyurethane material and the bottom sheet 30 may include a textile material, or both the top sheet 28 and the bottom sheet 30 may include a textile material, or both the top sheet 28 and the bottom sheet 30 may include a thermoplastic polyurethane material.

The top sheet 28 may be secured to the bottom sheet 30 at the peripheral flange 24A by thermal bonds connecting the inner surface of the periphery 28A of the top sheet 28 to the inner surface of the periphery 30A of the bottom sheet 30 to define the peripheral flange 24A, by welding (e.g., radio-frequency welding) to connect the inner surface of the periphery 28A of the top sheet 28 to the inner surface of the periphery 30A of the bottom sheet 30 to define the peripheral flange 24A, by adhering (e.g., with adhesive applied to one or both of the top sheet and the bottom sheet 30 between) to connect the inner surface of the periphery 28A of the top sheet 28 to the inner surface of the periphery 30A of the bottom sheet 30 to define the peripheral flange 24A, by compression molding with pressure causing the inner surface of the periphery 28A of the top sheet 28 to join to the inner surface of the periphery 30A of the bottom sheet 30 to define the peripheral flange 24A, and/or by sewing the periphery 28A of the top sheet 28 to the periphery 30A of the bottom sheet 30 to define the peripheral flange 24A.

In FIG. 2, the periphery 28A of the top sheet 28 is secured to the periphery 30A of the bottom sheet 30 with stitching 40, also referred to herein as a first series of stitches 40. In FIG. 3, an alternative strobel 12A is alike in all aspects to strobel 12 except that the periphery 28A of the top sheet 28 is secured to the periphery 30A of the bottom sheet 30 at the interface 35 of the inner surfaces 32, 34 of the sheets 28, 30 with adhesive, thermal bonding, and/or due to compression molding without any stitching used to secure the sheets 28, 30 to one another at the peripheral flange 24A.

Figure 12:
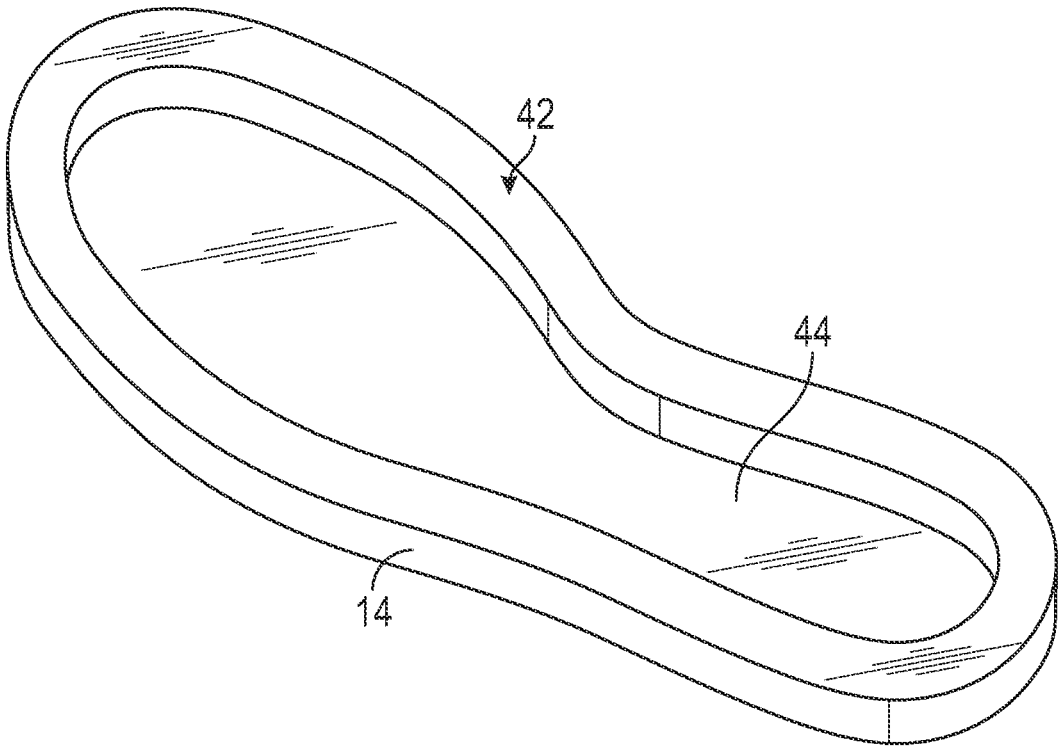
FIG. 12 is a perspective view of a midsole having an upper surface that defines a recess.

The upper surface 42 of the midsole 14 defines a recess 44, as best shown in FIG. 12. For example, the midsole 14 may be a molded foam in which the mold cavity imparts the recess 44 at the upper surface 42. Alternatively, the midsole 14 could be cut or sculpted to provide the recess 44. As shown in FIG. 4, the strobel 12 rests on the upper surface 42 of the midsole 14 in the recess 44 such that at least a portion of the cushioning member 36 is disposed in the recess 44 and below the peripheral flange 24A. By nesting at least a portion of the thickness of the strobel 12 in the recess 44 below the peripheral flange 24A, the overall stack height of the midsole 14 and the strobel 12 is less than if no recess 44 were provided, any height difference between the top sheet 28 at the peripheral flange 24A (e.g., at the periphery 28A) and the top sheet 28 over the cushioning member 36 is less noticeable to the wearer, and the midsole 14 is better able to maintain lateral (e.g., transverse) stability of the strobel 12 relative to the midsole 14 by at least partially surrounding the side wall 37 of the cushioning member 36 outward of the casing 24.

Figure 5:
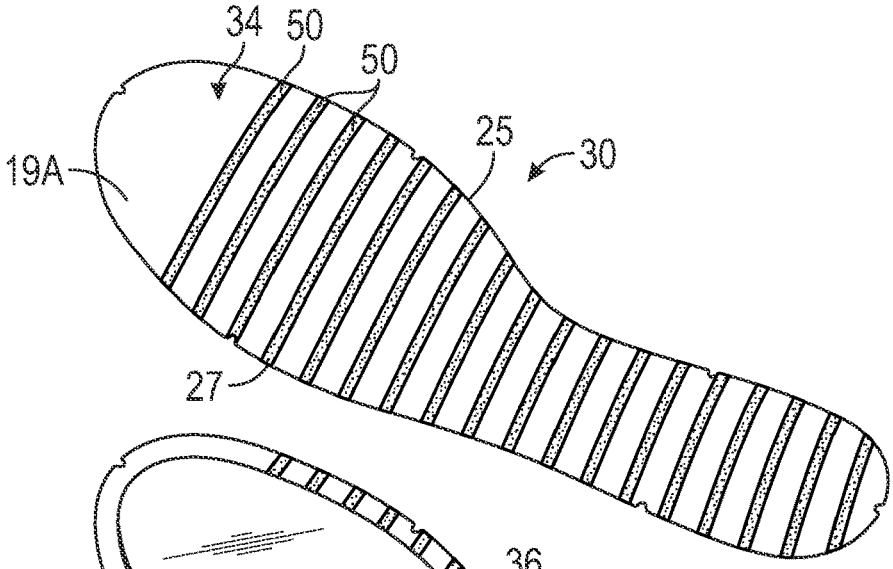
FIG. 5 is a perspective illustration of a bottom sheet of the casing of the strobel of FIG. 2 with adhesive disposed thereon.

FIGS. 5-13 illustrate some of the steps of a method 1600 of manufacturing the article of footwear 10. The method 1600 is also discussed with respect to the flow diagram of FIG. 50. FIG. 5 shows the bottom sheet 30 with adhesive 50 disposed on the inner surface 34 (e.g., the surface that will be the inner surface 34 of the casing 24 of FIG. 2, in the assembled strobel 12). The adhesive 50 is shown disposed in generally parallel rows extending lengthwise from the medial side 25 to the lateral side 27 of the bottom sheet 30. At least a portion 19A of the forefoot region 19 of the bottom sheet 30 may be kept free from adhesive 50. Although shown disposed in rows, the adhesive 50 may instead be disposed in a single loop that generally follows the contours of the outer perimeter of the bottom sheet 30 slightly inward of the outer perimeter.

Figure 6:
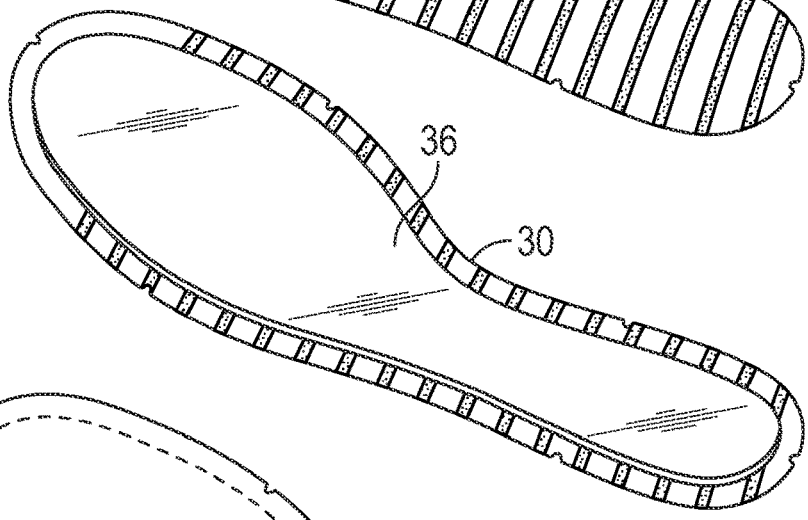
FIG. 6 is a perspective illustration of the bottom sheet of FIG. 1 with the cushioning component of FIG. 2 thereon.
Figure 7:
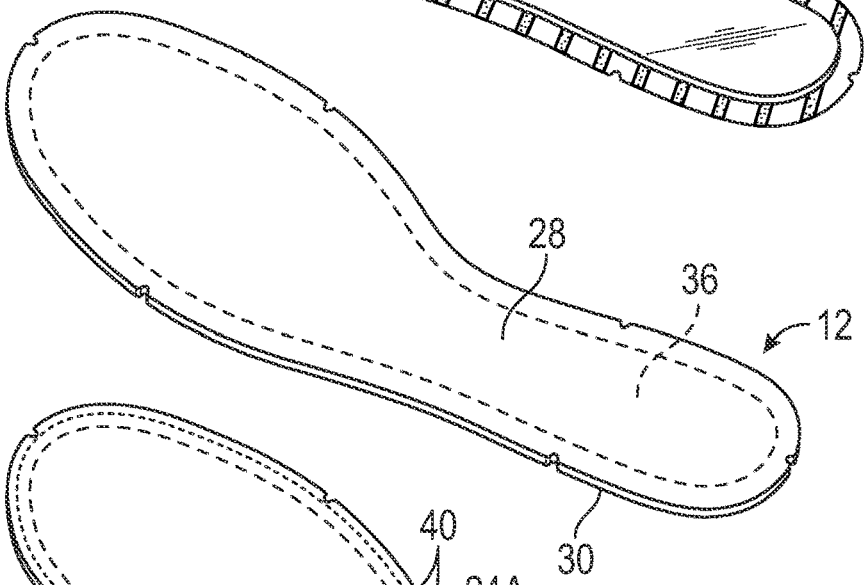
FIG. 7 is a perspective illustration of a top sheet of the casing of the strobel of FIG. 2 overlying the cushioning component and bottom sheet of FIG. 6.

FIG. 6 shows the cushioning member 36 disposed on the inner surface 34 (see FIG. 3) of the bottom sheet 30 over the adhesive 50. FIG. 7 shows the top sheet 28 then disposed over the cushioning member 36 so that the cushioning member 36 is between the inner surfaces 32, 34 of the top sheet 28 and the bottom sheet 30 as in FIG. 2. If any adhesive extends on the inner surface 34 outward of the cushioning member 36, the inner surfaces 32, 34 of the sheets 28, 30 can be placed into contact with one another at the peripheries 28A, 30A around the cushioning member 36 to define the peripheral flange 24A and enclose the cushioning member 36 in the internal cavity 26 shown in FIG. 2.

Figure 8:
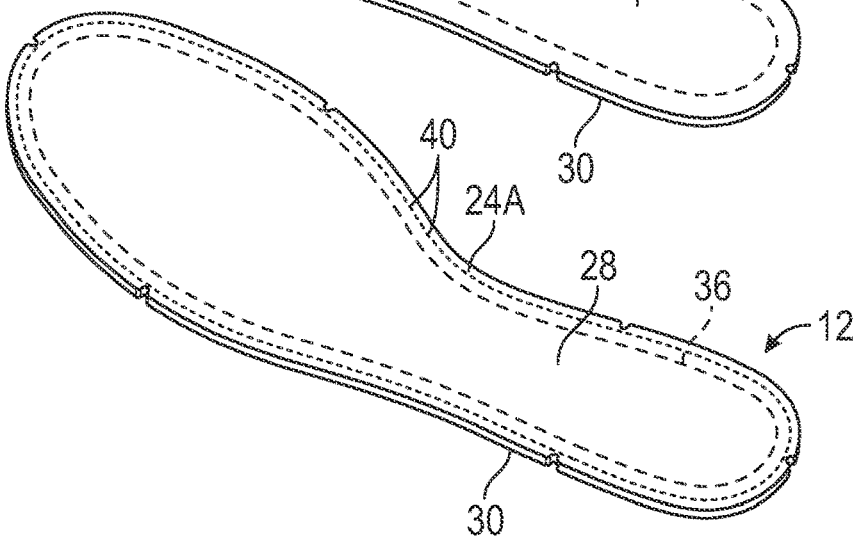
FIG. 8 is a perspective illustration of the top sheet and the bottom sheet secured at a peripheral flange via stitching, with the cushioning member in a cavity formed between the sheets.

Instead or in addition to adhering the inner surfaces 32, 34 at the peripheral flange 24A, the sheets 28, 30 can be sewn together at the peripheries 28A, 30A with the first series of stitches 40 to define the peripheral flange 24A as shown in FIG. 8. Thermal bonding (e.g., heat sealing), welding (e.g., radio-frequency welding) and/or compression molding are other possible steps for securing the peripheries 28A, 30A of the sheets 28, 30 to one another to define the peripheral flange 24A. Manufacturing of the strobel 12 of FIG. 8 is now complete and the casing 24 and cushioning member 36 are a single unit for convenient handling when securing to the upper 16. The strobel 12 can alternatively be assembled by placing the cushioning member 36 on the inner surface 32 of the top sheet 28 (e.g., with the top sheet 28 resting upside down on its exterior surface 18), and then placing the bottom sheet 30 over the cushioning member 36 before stitching at the peripheral flange 24A.

Figure 9:
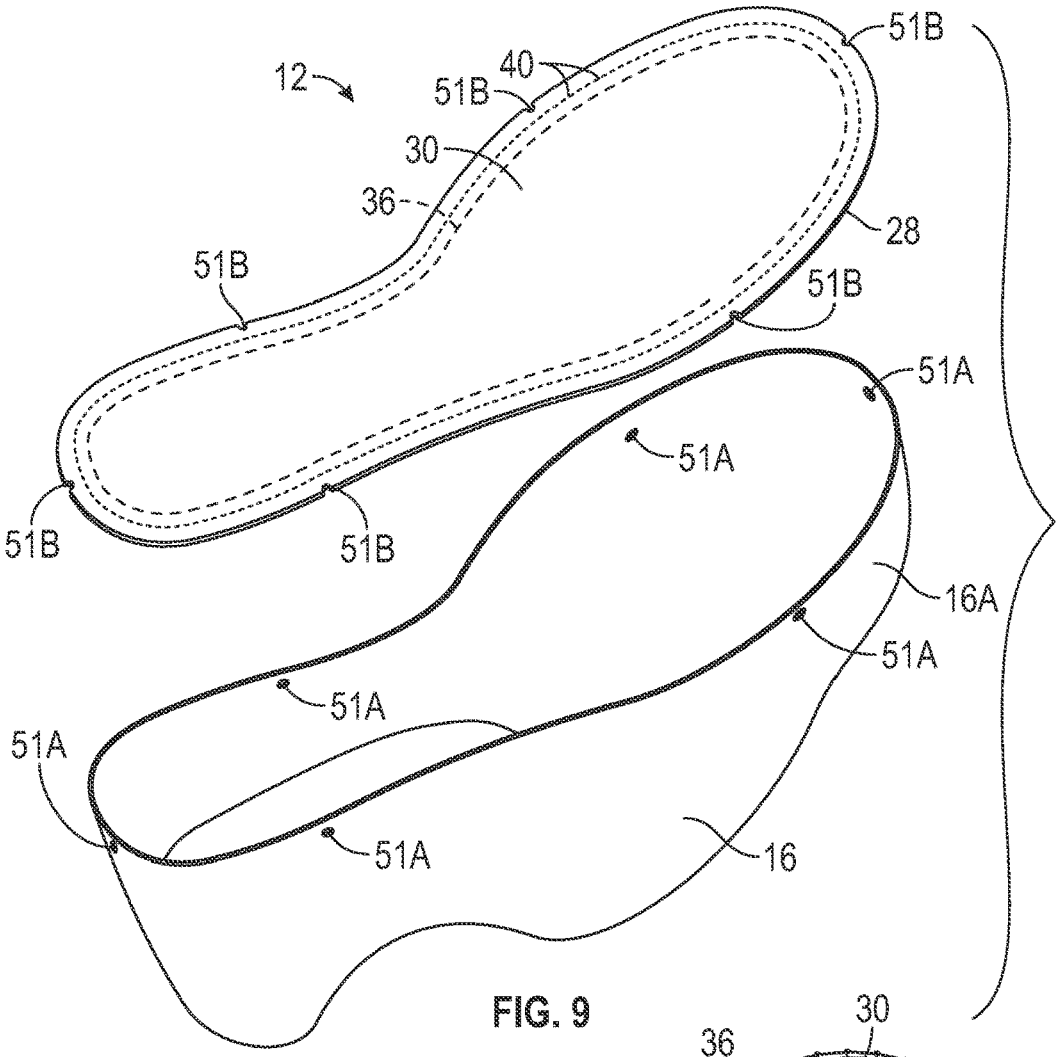
FIG. 9 is a perspective view of the strobel of FIG. 8 aligned with a footwear upper.

In FIG. 9, the strobel 12 is shown aligned with the lower perimeter 16A of the upper 16. The upper 16 may have locating features that are spaced markings, notches, protrusions, or apertures along its lower perimeter 16A near where it is stitched to the strobel 12. The strobel 12 may also have locating features (e.g., the notches, markings, and/or apertures) that may have a relative spacing identical to that of the locating features of the upper 16. The locating features of the upper 16 may be aligned with those of the strobel 12 prior to stitching or otherwise securing the peripheral flange 24A of the strobel 12 to the lower perimeter 16A of the upper 16 so that the upper 16 and strobel 12 are properly aligned with one another when stitching along the peripheral flange 24A. In FIG. 9, the upper 16 is shown with locating features (e.g., markings or apertures 51A) that can be aligned with locating features (e.g., notches 51B) of the strobel 12 for this purpose.

Figure 10:
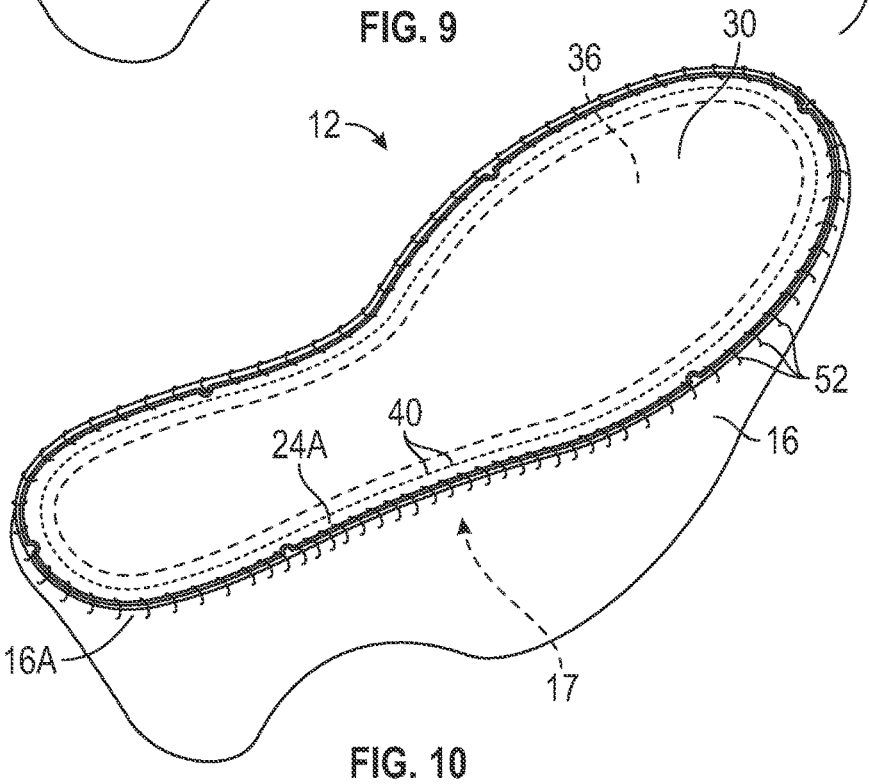
FIG. 10 is perspective view of the upper of FIG. 9 joined to the strobel of FIG. 9 at the peripheral flange.

The peripheral flange 24A of the casing 24 is then secured to the lower perimeter 16A of the upper 16 as shown in FIG. 10. For example, securing the peripheral flange 24A to the upper 16 may be by sewing using a strobel machine. A second series of stitches 52 (also referred to herein as stitching 52) is shown in FIG. 10 extending around the entire peripheral flange 24A outward of the first series of stitches 40, if stitches 40 are used to secure the sheets 28, 30 to one another at the peripheral flange 24A. Once the strobel 12 is secured to the upper 16 in this manner, the upper 16 and the strobel 12 define the foot-receiving void 17 of the article of footwear 10, with the exterior surface 18 of the casing 24 facing away from the cavity 26 (see FIG. 2) of the strobel 12. Stated differently, the top surface 18 of the top sheet 28 is a foot contact surface 18 of the strobel 12 within the foot-receiving void 17.

Figure 11:
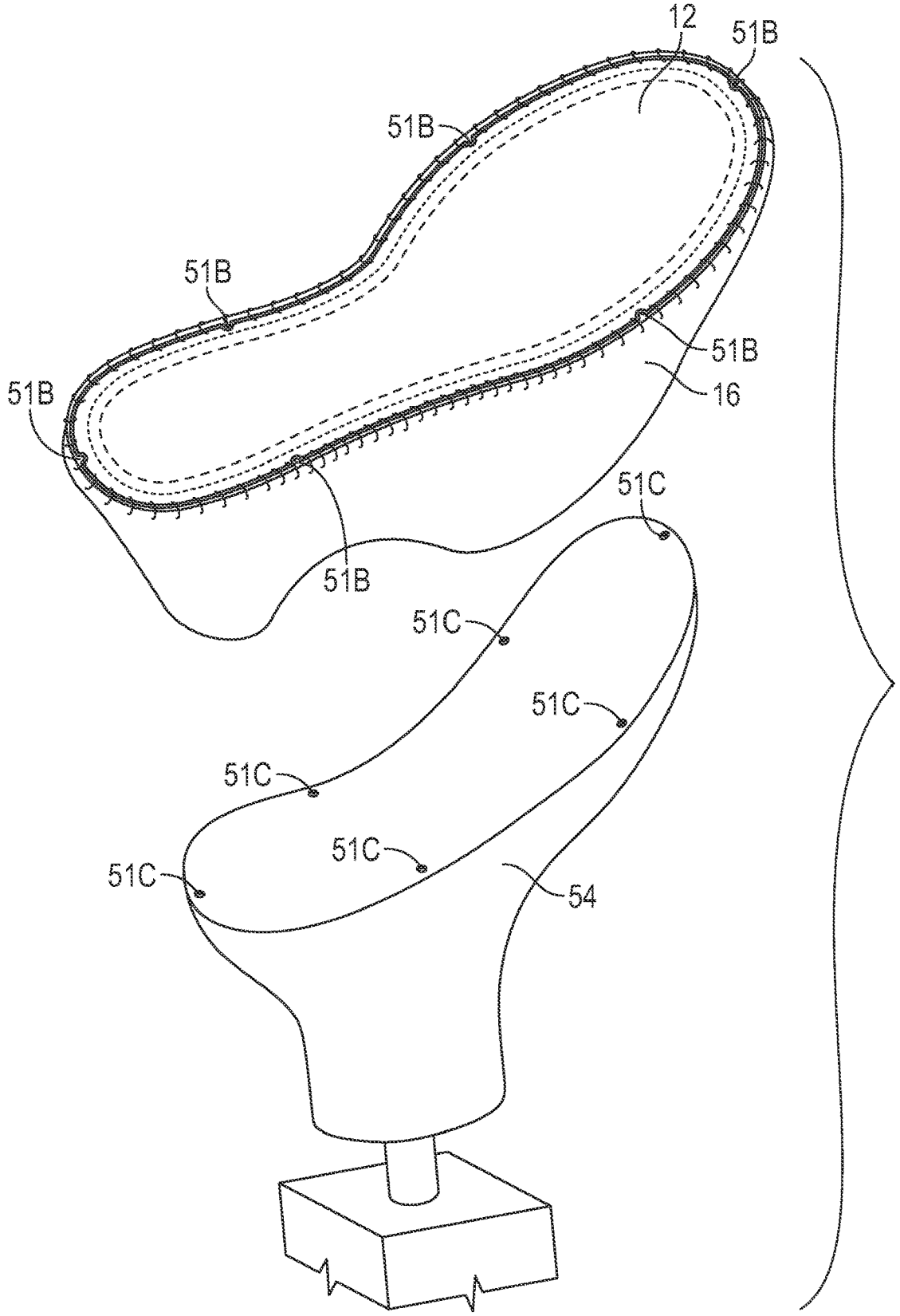
FIG. 11 is a perspective view of the upper and strobel of FIG. 10 aligned with a footwear last for placement thereon.

Referring to FIG. 11, the upper 16 with the strobel 12 secured thereto is now placed on a footwear last 54, a manufacturing step that is referred to as lasting the upper 16. The last 54 can be configured with locating features that have the same relative spacing as locating features of the strobel 12 and/or the upper 16. As shown in FIG. 11, the locating features 51C may be, for example, markings on or apertures in the last 54 that align with locating features 51B of the strobel 12. The lasting process ensures that the upper 16 is sufficiently stretched and shaped to properly secure to the midsole 14. The strobel 12 is configured (e.g., properly shaped and sized) to secure to the lower perimeter 16A helping to ensure a properly shaped upper 16.

Figure 13:
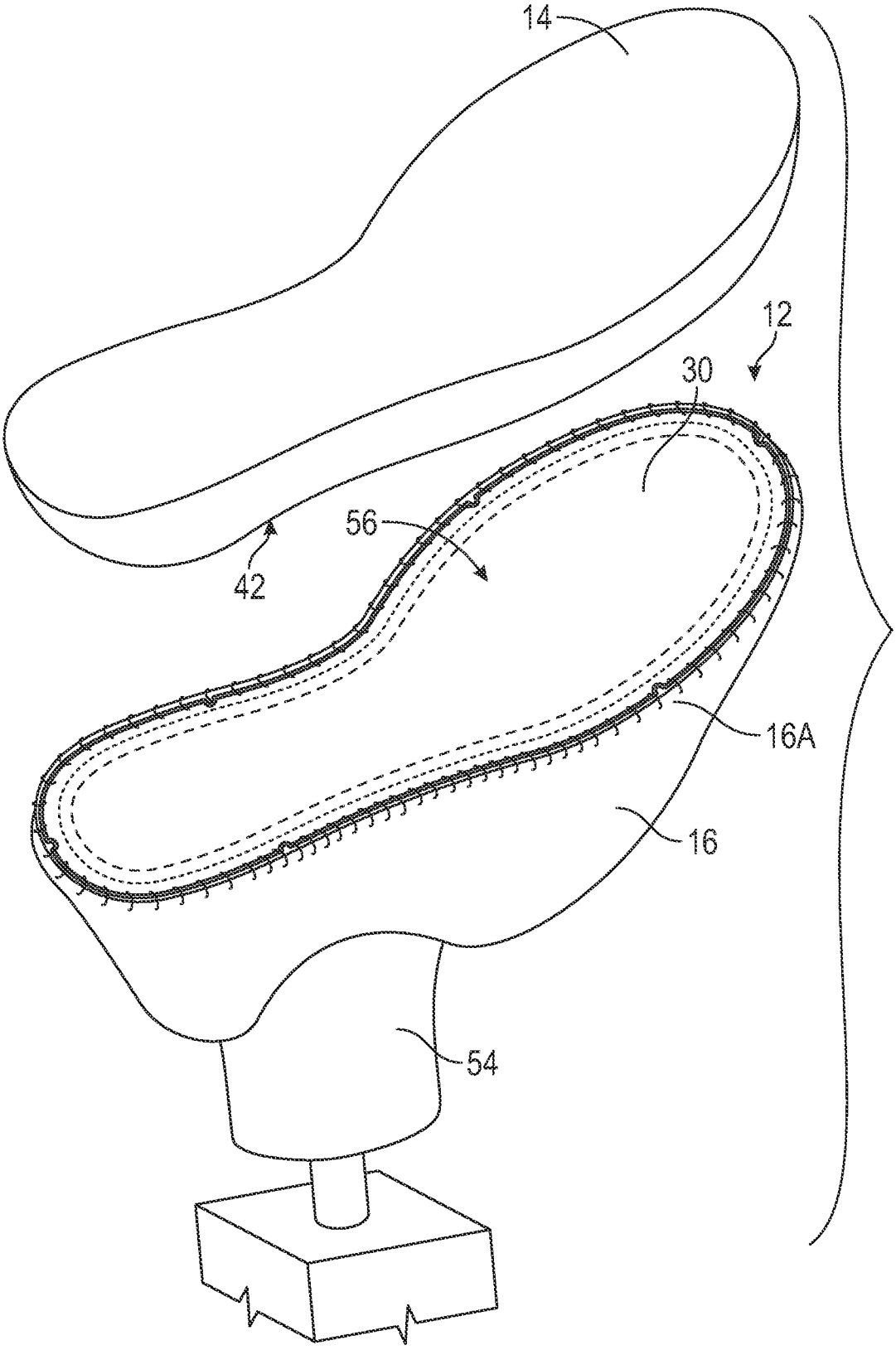
FIG. 13 is a perspective view of the midsole of FIG. 12 aligned with the lasted strobel and upper for attachment thereto.

The midsole 14 with the recess 44 in the upper surface 42 shown in FIG. 12 is then aligned with the lower exterior surface 56 of the bottom sheet 30 of the strobel 12 (e.g., the bottom exterior surface 56 of the strobel 12) with the upper surface 42 facing the bottom exterior surface 56 as shown in FIG. 13. Adhesive may be disposed on the upper surface 42 of the midsole 14 and/or on the exterior surface 56 of the strobel 12 or the lower perimeter 16A of the upper 16, and the midsole 14 is pressed against the bottom exterior surface 56 and the lower perimeter 16A of the upper 16 to secure the upper surface 42 of the midsole 14 to at least one of the upper 16 or the lower exterior surface 56 of the strobel 12 such that at least a portion of the cushioning member 36 rests in the recess 44 in the upper surface 42 of the midsole 14 below the peripheral flange 42A as discussed with respect to FIG. 4.

Figure 14:
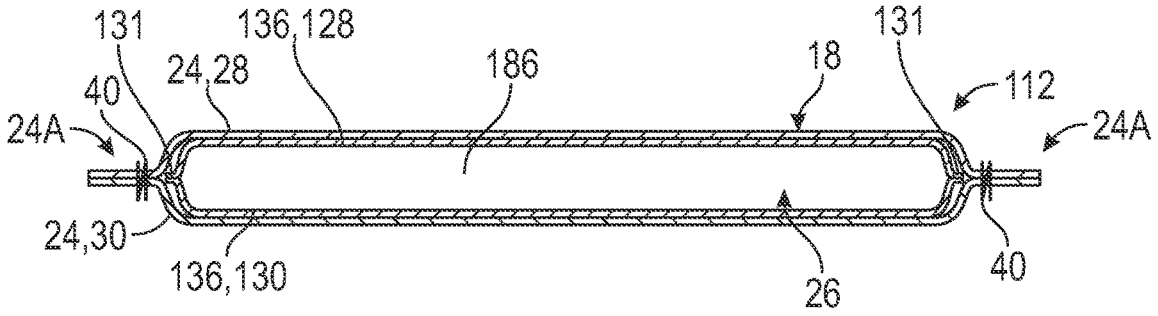
FIG. 14 is a cross-sectional illustration of another example of a strobel including a casing and a cushioning member.

FIG. 14 is a cross-sectional illustration of another example of a strobel 112 including the casing 24 and at least one cushioning member 136. The strobel 112 is identical to the strobel 12 except that the cushioning member 136 is a fluid-filled chamber used in place of the foam cushioning member 36. The cushioning member 136 includes a first polymeric sheet 128 and a second polymeric sheet 130. The first polymeric sheet 128 is secured to the second polymeric sheet 130 at a peripheral flange 131 to enclose an interior cavity 186 defined by the polymeric sheets between inner surfaces of the polymeric sheets 128, 130. Stated differently, when the polymeric sheets 128, 130 are secured together at the peripheral flange 131 and sealed, the first polymeric sheet 128 and the second polymeric sheet 130 retain a fluid in the interior cavity 186, and the secured polymeric sheets 128, 130 may be referred to as a fluid-filled chamber or bladder. As used herein, a "fluid" filling the interior cavity 186 may be a gas, such as air, nitrogen, another gas, or a combination thereof. The cushioning member 136 may be "full length" extending in the forefoot region 19, the midfoot region 21, and the heel region 23, or may extend only in one of the regions, 19, 21, or 23, or may extend in any two adjacent ones of the regions 19, 21, and 23.

The first and second polymeric sheets 128, 130 can be a variety of polymeric materials that can resiliently retain a fluid such as nitrogen, air, or another gas. Examples of polymeric materials for the first and second polymeric sheets 128, 130 include thermoplastic urethane, polyurethane, polyester, polyester polyurethane, and polyether polyurethane. Moreover, the first and second polymeric sheets 128, 130 can each be formed of layers of different materials including polymeric materials. In one embodiment, each of the first and second polymeric sheets 128, 130 is formed from thin films having one or more thermoplastic polyurethane layers with one or more barrier layers of a copolymer of ethylene and vinyl alcohol (EVOH) that is impermeable to the pressurized fluid contained therein such as a flexible microlayer membrane that includes alternating layers of a gas barrier material and an elastomeric material, as disclosed in U.S. Pat. Nos. 6,082,025 and 6,127,026 to Bonk et al. which are incorporated by reference in their entireties. Alternatively, the layers may include ethylene-vinyl alcohol copolymer, thermoplastic polyurethane, and a regrind material of the ethylene-vinyl alcohol copolymer and thermoplastic polyurethane. Additional suitable materials for the first and second polymeric sheets 128, 130 are disclosed in U.S. Pat. Nos. 4,183,156 and 4,219,945 to Rudy which are incorporated by reference in their entireties. Further suitable materials for the first and second polymeric sheets 128, 130 include thermoplastic films containing a crystalline material, as disclosed in U.S. Pat. Nos. 4,936,029 and 5,042,176 to Rudy, and polyurethane including a polyester polyol, as disclosed in U.S. Pat. Nos. 6,013,340, 6,203,868, and 6,321,465 to Bonk et al. which are incorporated by reference in their entireties. In selecting materials for the cushioning member 136, engineering properties such as tensile strength, stretch properties, fatigue characteristics, dynamic modulus, and loss tangent can be considered. For example, the thicknesses of the first and second polymeric sheets 128, 130 can be selected to provide these characteristics.

The casing 24, including the top sheet 28, the bottom sheet 30, and the peripheral flange 24A at which the sheets 28, 30 are joined by stitching 40 or otherwise is the same as described with respect to FIG. 2. The top sheet 28 may conform to the first polymeric sheet 128 and the lower sheet 30 may conform to the second polymeric sheet 130 and/or inner surfaces of the sheets 28, 30 may be adhered to exterior surfaces of the first and second polymeric sheets 128, 130. The peripheral flange 131 of the cushioning member 136 may be entirely or at least partially inward of the peripheral flange 24A of the casing 24 so that the upper and lower sheets 28, 30 interface with one another at the peripheral flange 24A.

Figure 15:
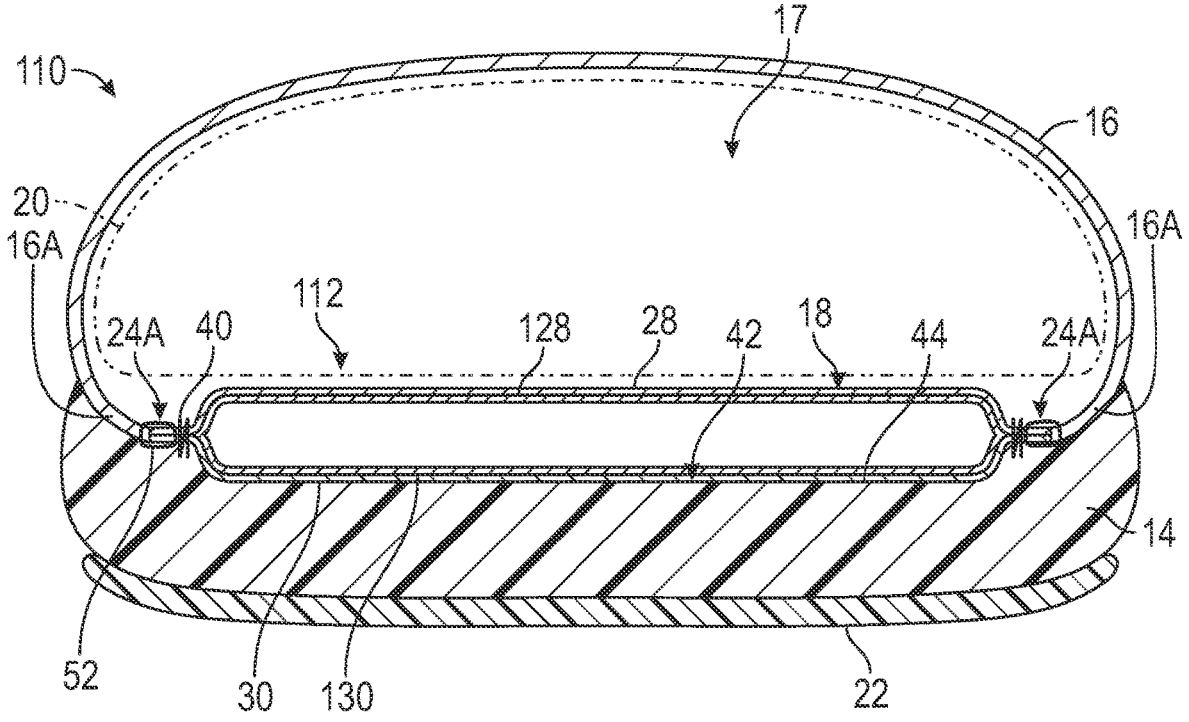
FIG. 15 is a cross-sectional illustration of an article of footwear including the strobel of FIG. 14.

FIG. 15 is a cross-sectional illustration of an article of footwear 110 including the strobel 112 of FIG. 14. The article of footwear 110 is manufactured in the same manner as described with respect to the article of footwear 10 of FIG. 4, except using strobel 112 instead of strobel 12, and with the exterior surface of the top sheet 28 being the foot-contact surface 18 of the strobel 112 within the void 17.

Figure 16:
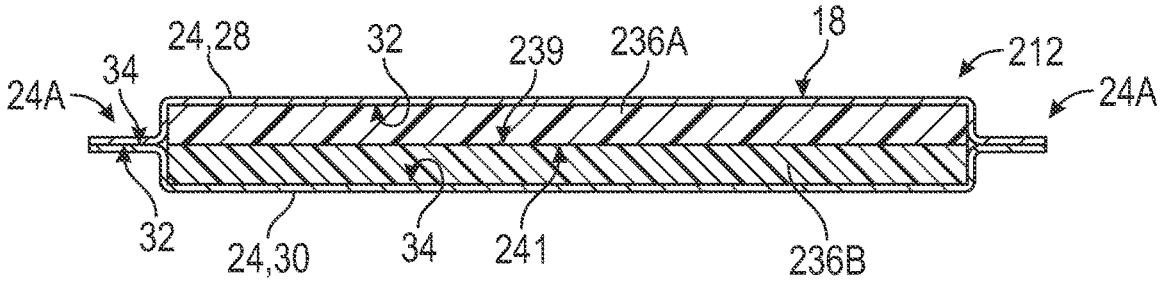
FIG. 16 is a cross-sectional illustration of another example of a strobel including a casing and a cushioning member.

FIG. 16 is a cross-sectional illustration of another example of a strobel 212 including the casing 24 as described with respect to FIGS. 1-4, and including both a first cushioning member 236A and a second cushioning member 236B in place of the single cushioning member 36. Accordingly, the strobel 212 is identical to the strobel 12 except that a first cushioning member 236A and a second cushioning member 236B are included, and at least a portion of the first cushioning member 236A overlies the second cushioning member 236B. Both of the cushioning members 236A, 236B may be "full length" extending in the forefoot region 19, the midfoot region 21, and the heel region 23, and may have the same shape in the X and Y directions so that the first cushioning member 236A completely overlies the second cushioning member 236B. The height of the strobel 212 is thus dependent upon the thickness of the first cushioning member 236A and the thickness of the second cushioning member 236B at the cross section shown, where thickness is in the Z direction (vertically in the view shown). Alternatively, the cushioning members 236A, 236B may have different lengths and/or widths so that, at some portions of the strobel 212, the height of the strobel 212 in the Z direction is dependent in part on the thickness of the first cushioning member 236A but not on the thickness of the second cushioning member 236B, or vice versa.

As shown in FIG. 16, the cushioning member 236A is disposed between the foot contact surface 18 of the strobel 212 and the second cushioning member 236B. More specifically, the cushioning member 236A is disposed between the top sheet 28 of the casing 24 and the upper surface 239 of the second cushioning member 236B, and the second cushioning member 236B is disposed between the lower surface 241 of the first cushioning member 236A and the bottom sheet 30. The first cushioning member 236A and the second cushioning member 236B may differ in at least one of material, hardness, energy return, or density. For example, the first cushioning member 236A and the second cushioning member 236B may each include a different foam material and/or may have a different hardness, energy return, or density. In one example, the second cushioning member 236B may be a foam material with a greater hardness than that of the first cushioning member 236A so that the softer first cushioning member is closer to the foot contact surface 18.

Additionally, although the cushioning members 236A, 236B are shown having the same thickness (e.g., height in the Z direction), they may have different heights. For example, the first cushioning member 236A may be thinner than the second cushioning member 236B or may be thicker than the second cushioning member 236B. Moreover, the thicknesses of each of the cushioning members 236A, 236B may vary in different regions of the strobel 212. In one non-limiting example, the first cushioning member 236A may be thicker than the second cushioning member 236B in the heel region 23, thinner than the second cushioning member in the midfoot region 21, and thicker than the second cushioning member 236B in the forefoot region 19.

The method of manufacturing the strobel 212 includes arranging the first cushioning member 236A and the second cushioning member 236B so that at least a portion of the first cushioning member 236A overlies the second cushioning member 236B in the completed strobel 212. With reference to FIG. 6, for example, instead of the cushioning member 36, first the second cushioning member 236B would be placed on the bottom sheet 30 so that the second cushioning member 236B interfaces with the inner surface 34 of the bottom sheet 30, and then the first cushioning member 236A would be placed on the second cushioning member 236B before placing the top sheet 28 over the first cushioning member 236A so that the first cushioning member 236A interfaces with the inner surface 32 of the top sheet 28. Placing the first cushioning member 236A and the second cushioning member 236B relative to one another in this manner interfits the first cushioning member 236A with the second cushioning member 236B in the cavity 26 of the formed strobel 212 so that a first portion of an inner surface of the casing 24 (e.g., the inner surface 32 of the top sheet 28) interfaces with the first cushioning member 236A, and a second portion of the inner surface of the casing 24 (e.g., the inner surface 34 of the bottom sheet 30) interfaces with the second cushioning member 236B.

In FIG. 16, the strobel 212 is depicted as having the inner surface 32 of the top sheet 28 of the casing 24 bonded to the inner surface 34 of the bottom sheet 30 of the casing at the peripheral flange 24A to secure the top sheet 28 to the bottom sheet 30 without a first series of stitches 40. For example, the surfaces 32, 34 can be secured to one another at the peripheral flange 24A by thermal bonding, compression bonding, welding (e.g., radio-frequency welding), or by adhesive disposed on one or both inner surfaces 32, 34. Alternatively or in addition, stitching with the first series of stitches 40 shown in FIG. 1 could be used.

Figure 17:
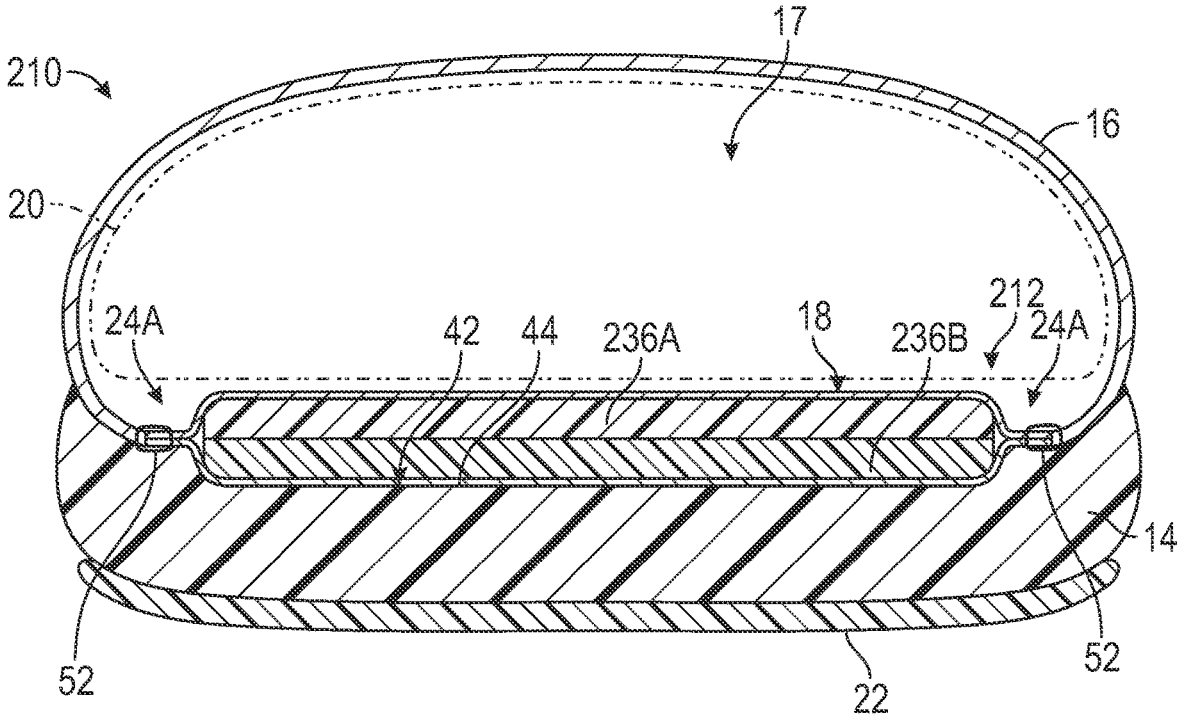
FIG. 17 is a cross-sectional illustration of an article of footwear including the strobel of FIG. 16.

FIG. 17 is a cross-sectional illustration of an article of footwear 210 including the strobel 212 of FIG. 16. Except for the arrangement of both first and second cushioning members 236A and 236B and forming the strobel 212 by securing the sheets 28, 30 at the peripheral flange 24A by thermal bonding, compression bonding, welding, or adhesive rather than or in addition to by stitching, the article of footwear 210 is manufactured in the same manner as described with respect to the article of footwear 10 of FIG. 4, using strobel 212 instead of strobel 12, and with the exterior surface 18 of the top sheet 28 being the foot-contact surface within the void 17. The article of footwear 210 is characterized by the absence of an insole.

Figure 18:
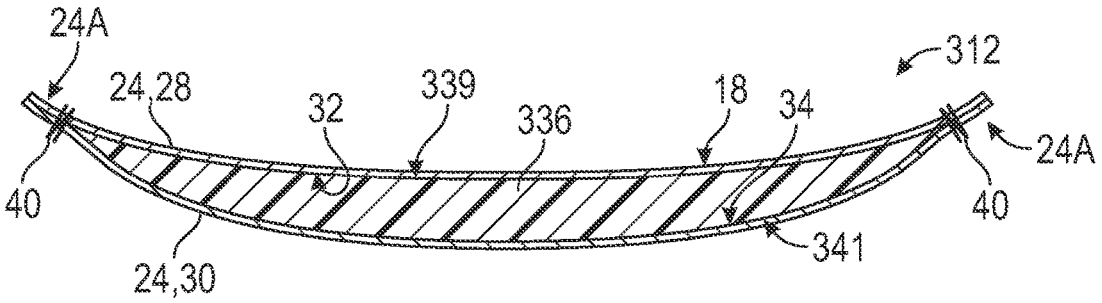
FIG. 18 is a cross-sectional illustration of another example of a strobel including a casing and a cushioning member.

FIG. 18 is a cross-sectional illustration of another example of a strobel 312 including the casing 24 and at least one cushioning member 336. The strobel 312 is identical to the strobel 12 except that the cushioning member 336 is used in place of the cushioning member 36. At least a portion of a top surface 339 of the cushioning member 336 interfacing with the top inner surface 32 of the casing 24 is concave. Additionally, in the example shown, at least a portion of the bottom surface 341 of the cushioning member 336 interfacing with the bottom inner surface 34 of the casing 24 is convex. The convex portion underlies the concave portion in the cross section taken along a vertical plane as shown in FIG. 18. The cushioning member 336 may be molded or cut to provide the concave upper surface 339 and/or the convex bottom surface 341. Because the top sheet 28 and the lower sheet 30 are flexible, relatively elastic material as described, they conform to the concave and convex portions of the cushioning member 336. The cushioning member 336 may be "full length" extending in the forefoot region 19, the midfoot region 21, and the heel region 23, or may extend only in one of the regions, 19, 21, or 23, or may extend in any two adjacent ones of the regions 19, 21, and 23.

Figure 19:
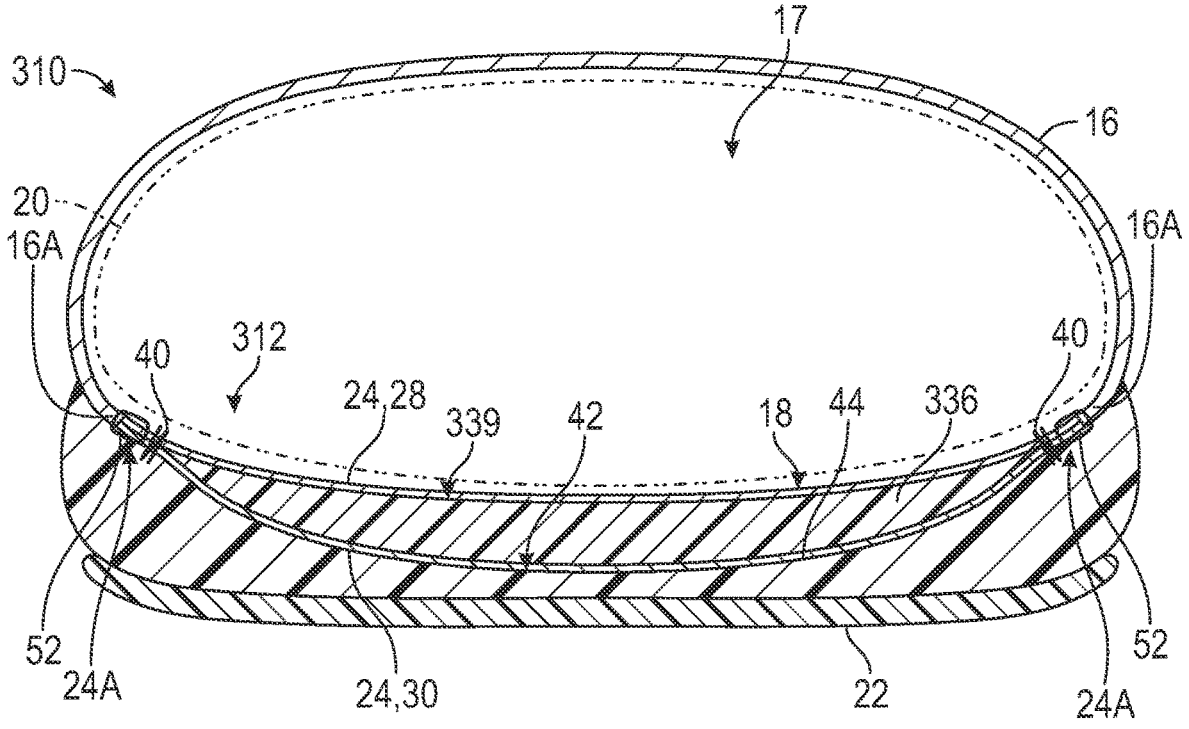
FIG. 19 is a cross-sectional illustration of an article of footwear including the strobel of FIG. 18.

FIG. 19 is a cross-sectional illustration of an article of footwear 310 including the strobel 312 of FIG. 18. The article of footwear 310 is manufactured in the same manner as described with respect to the article of footwear 10 of FIG. 4, except using strobel 312 instead of strobel 12, and with the exterior surface 18 of the top sheet 28 being the foot-contact surface within the void 17. The recess 44 in the midsole 14 may be shaped so that the concave top surface 339 retains its concave shape in the void 17, such as by shaping the recess to follow the contour of the lower surface 341 of the cushioning member 336, as shown in FIG. 19. Accordingly, the foot contact surface 18 will be presented to the foot 20 as a concave surface. The article of footwear 310 is characterized by the absence of an insole.

Figure 20:
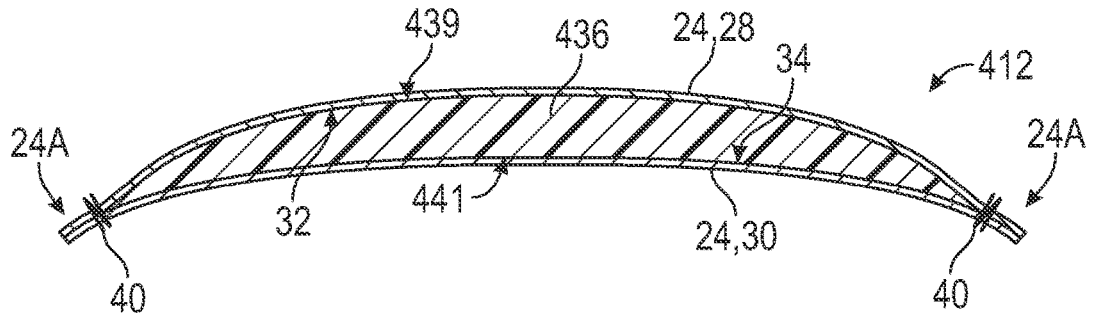
FIG. 20 is a cross-sectional illustration of another example of a strobel including a casing and a cushioning member.

FIG. 20 is a cross-sectional illustration of another example of a strobel 412 including the casing 24 and at least one cushioning member 436. The strobel 412 is identical to the strobel 12 except that the cushioning member 436 is used in place of cushioning member 36. The cushioning member 436 may be "full length" extending in the forefoot region 19, the midfoot region 21, and the heel region 23, or may extend only in one of the regions, 19, 21, or 23, or may extend in any two adjacent ones of the regions 19, 21, and 23. At least a portion of a top surface 439 of the cushioning member 436 interfacing with the top inner surface 32 of the casing 24 is convex. Additionally, in the embodiment shown, at least a portion of the bottom surface 441 of the cushioning member 436 interfacing with the bottom inner surface 34 of the casing 24 is concave. The concave portion underlies the convex portion in the cross section taken along a vertical plane as shown in FIG. 20. The cushioning member 436 may be molded or cut to provide the convex top surface 439 and/or the concave bottom surface 441. Because the top sheet 28 and the bottom sheet 30 are flexible, relatively elastic material as described, they conform to the convex and concave portions of the cushioning member 336.

Figure 21:
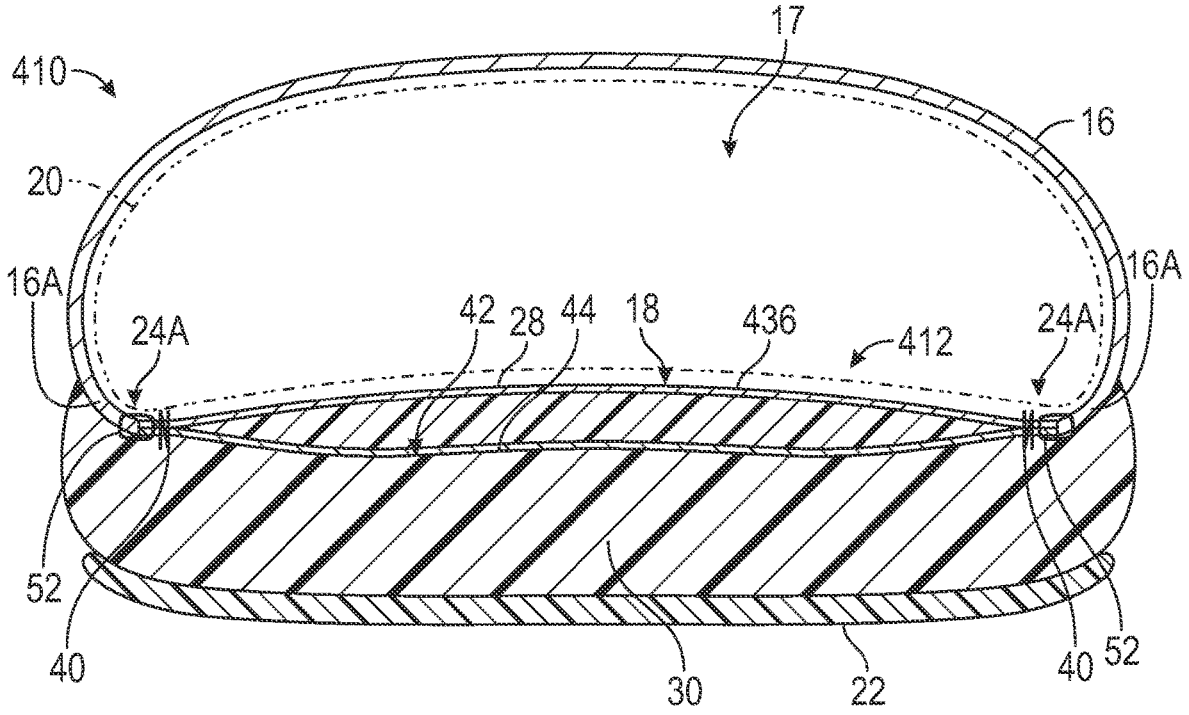
FIG. 21 is a cross-sectional illustration of an article of footwear including the strobel of FIG. 20.

FIG. 21 is a cross-sectional illustration of an article of footwear 410 including the strobel 412 of FIG. 20. The article of footwear 410 is manufactured in the same manner as described with respect to the article of footwear 10 of FIG. 4, except using strobel 412 instead of strobel 12, and with the exterior surface 18 of the top sheet 28 being the foot-contact surface within the void 17. The recess 44 in the midsole 14 may be shaped so that the convex top surface 439 retains at least some of its convex shape in the void 17, such as by shaping the recess 44 to follow the contour of the lower surface 441 of the cushioning member 436 when the strobel 412 is secured to the upper 16 and the midsole 14. Accordingly, the foot contact surface 18 will be presented to the foot 20 as a convex surface. This may be desirable in some regions of the footwear 410, such as in the midfoot region 21 to support the arch of the foot 20. The article of footwear 410 is characterized by the absence of an insole.

Figure 22:
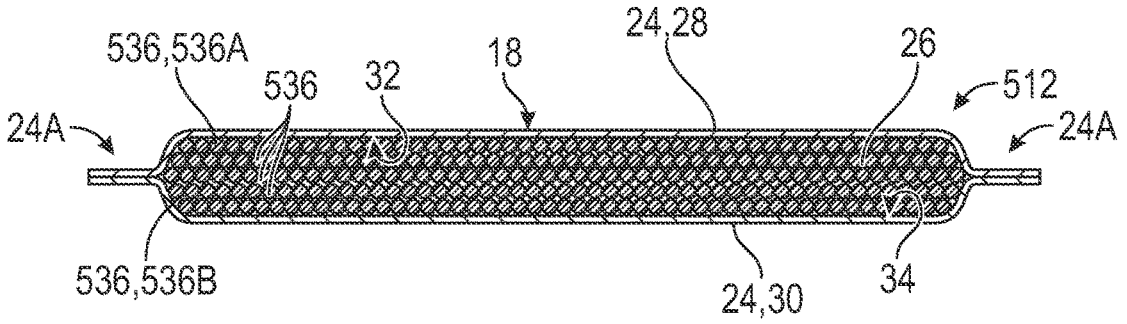
FIG. 22 is a cross-sectional illustration of another example of a strobel including a casing and a cushioning member.

FIG. 22 is a cross-sectional illustration of another example of a strobel 512 including the casing 24 and at least one cushioning member 536. The strobel 512 is identical to the strobel 12 except that multiple cushioning members 536 are used in place of cushioning member 36. Each cushioning member 536 may be a spherical bead or may have a three-dimensional shape with sides that are regular or irregular polygons. Each cushioning member 536 may be relatively small in volume in comparison to the volume of the cavity 26 so that multiple cushioning members overlay one another in the Z (vertical) direction, and abut one another in the X and Y directions within the cavity 26. The strobel 512 may be "full length" extending in the forefoot region 19, the midfoot region 21, and the heel region 23, or may extend only in one of the regions, 19, 21, or 23, or may extend in any two adjacent ones of the regions 19, 21, and 23. For example, a first cushioning member 536A is shown overlying a second cushioning member 536B and disposed between the foot contact surface 18 of the casing 24 and the second cushioning member 536B. The cushioning members 536 may be fixed relative to one another within the cavity 26, such as by bonding the cushioning members 536 to one another or to a binder coating the cushioning members 536. Alternatively, the cushioning members 536 may be unfixed relative to one another in the cavity 26 and unfixed relative to the inner surfaces 32, 34 of the upper and lower sheets 28, 30 of the casing 24 within the cavity 26. In this manner, the cushioning members 536 may shift in position within the cavity 26 under the weight of the foot 20.

Because the top and bottom sheets 28, 30 are flexible and elastic as described, the strobel 512 may conform to the lower surface of the foot 20. The cushioning members 536 may be, without limitation, a foam material as described with respect to the foam material of the cushioning member 36, for example. Each of the cushioning members 536 may be the same material, or there may be subsets of the cushioning members 536 comprised of different materials, and/or materials of different hardnesses, energy return, or densities.

The strobel 512 is depicted as having the inner surface 32 of the top sheet 28 of the casing 24 bonded to the inner surface 34 of the bottom sheet 30 of the casing at the peripheral flange 24A to secure the top sheet 28 to the bottom sheet 30 without a first series of stitches 40. For example, the surfaces 32, 34 can be secured to one another at the peripheral flange 24A by thermal bonding, compression bonding, welding (e.g., radio-frequency welding), or by adhesive disposed on one or both inner surfaces 32, 34. Alternatively or in addition, stitching with the first series of stitches 40 shown in FIG. 1 could be used. Initially, the peripheral flange 24A may be partially secured (e.g., around the periphery of the sheets 28, 30 except at the heel region, for example), leaving an opening through which the cushioning members 536 are poured into or otherwise disposed in the cavity 26, and then the remainder of the peripheral flange 24A can be secured to seal the cushioning members 536 within the cavity 26.

Figure 23:
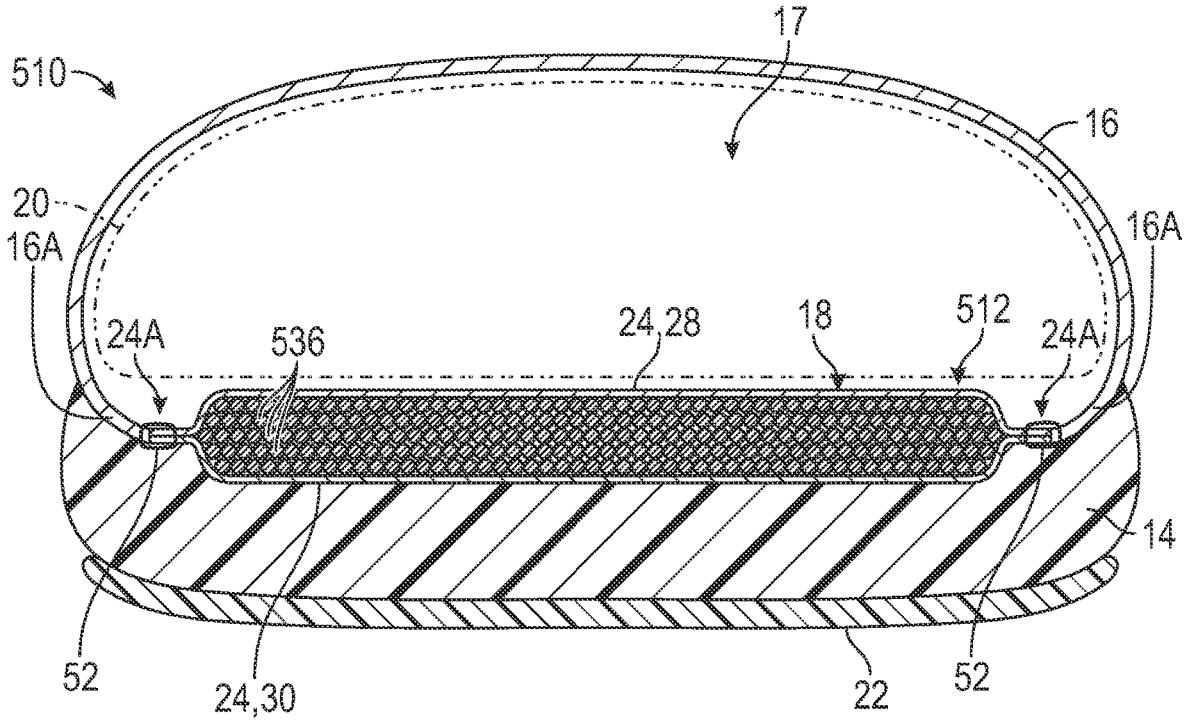
FIG. 23 is a cross-sectional illustration of an article of footwear including the strobel of FIG. 22.

FIG. 23 is a cross-sectional illustration of an article of footwear 510 including the strobel 512 of FIG. 22. Except for the plurality of cushioning members 536 and initially leaving an opening through which the cushioning members 536 are poured or otherwise disposed in the cavity 26, the article of footwear 510 is manufactured in the same manner as described with respect to the article of footwear 10 of FIG. 4, except using strobel 512 instead of strobel 12, so that the exterior surface 18 of the top sheet 28 is the foot-contact surface within the void 17. The article of footwear 510 is characterized by the absence of an insole.

Figure 24:
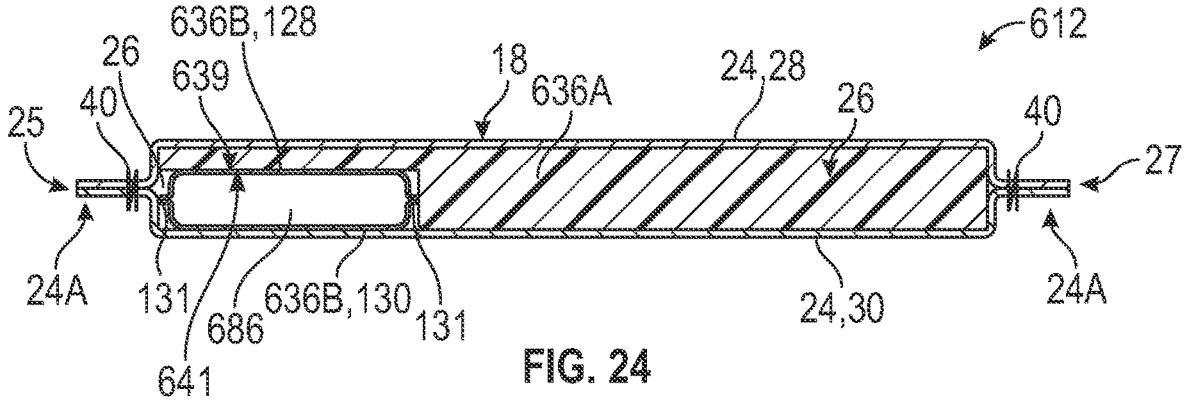
FIG. 24 is a cross-sectional illustration of another example of a strobel including a casing, a first cushioning member, and a second cushioning member.

FIG. 24 is a cross-sectional illustration of another example of a strobel 612 including the casing 24 as described with respect to FIGS. 1-4, and including both a first cushioning member 636A and a second cushioning member 636B disposed in the cavity 26 between the top and bottom sheets 28, 30 of the casing 24 in place of the single cushioning member 36. In the example shown, the first cushioning member 636A is a foam cushioning member, and may be any of the materials described with respect to the cushioning member 36. The second cushioning member 636B is a fluid-filled chamber with a first polymeric sheet 128 and a second polymeric sheet 130 configured as described with respect to the strobel 112, and secured to one another at a peripheral flange 131 to seal and enclose an interior cavity 686 and retain fluid in the interior cavity 686, similar to sheets 128, 130 enclosing the larger interior cavity 186 in FIG. 14.

Figure 25:
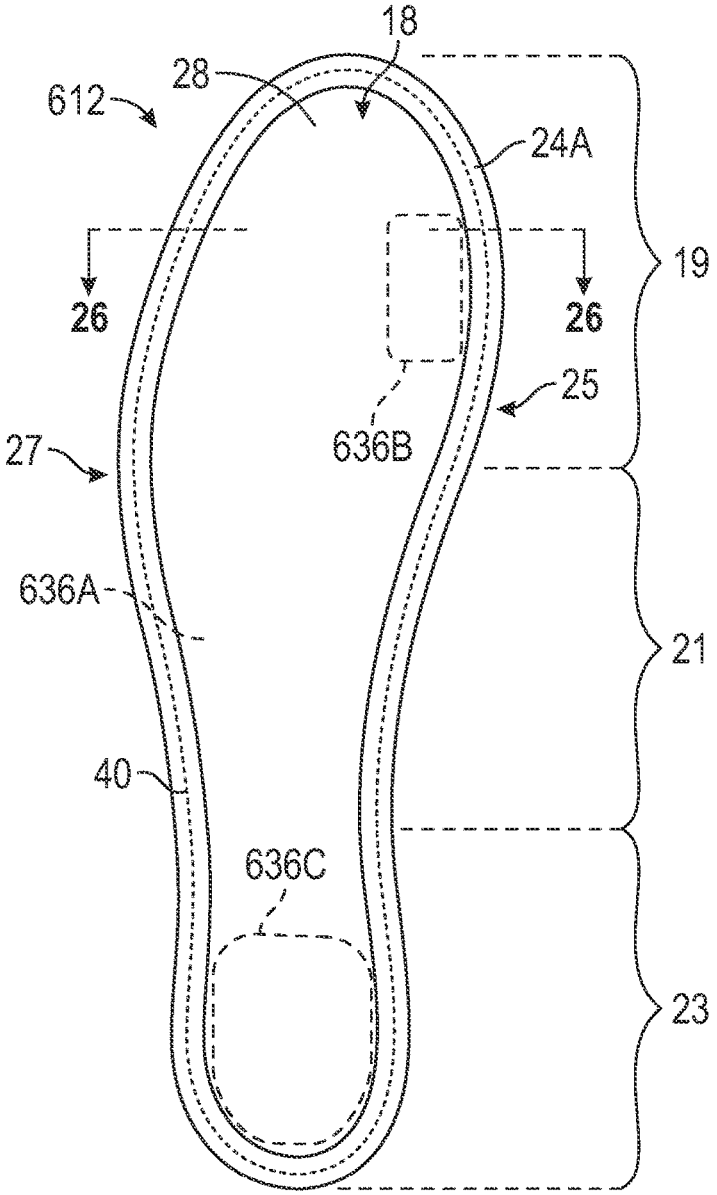
FIG. 25 is a plan view of the strobel of FIG. 24.

As is evident in FIG. 24, a portion of the first cushioning member 636A overlies the second cushioning member 636B. In the example shown, the cushioning member 636B does not extend the full length, height, or width of the cavity 26 and is instead limited to a portion of the forefoot region 19 at the medial side 25 of the forefoot region 19. This is best shown in FIG. 25 where the periphery of the second cushioning member 636B is represented with hidden lines below the overlying first cushioning member 636A. A third cushioning member 636C may be disposed in the heel region 23 of the cavity 26 with the first cushioning member 636A also overlying the third cushioning member 636C.

In the example shown, the first cushioning member 636A is a full length cushioning member, extending in the forefoot region 19, the midfoot region 21, and the heel region 23. The first cushioning member 636A varies in thickness and height. For example, the first cushioning member is relatively thin where it overlies the cushioning members 636B and 636C, and is relatively thick (e.g., has a greater height in the Z direction) where it alone fills the cavity 26, such as in the midfoot region 21 of the embodiment shown. The height of the strobel 412 is thus dependent upon the thickness of the first cushioning member 636A and the thickness of the second cushioning member 636B at the medial side 25 of the cross section shown, and is dependent only on the height of the first cushioning member 636A at the lateral side 27 of the cross-section shown.

As shown in FIG. 24, the first cushioning member 636A is disposed between the foot contact surface 18 of the strobel 612 and the second cushioning member 636B near the medial side 25 of the cross-section shown. More specifically, the cushioning member 636A is disposed between the top sheet 28 of the casing 24 and the upper surface 639 of the second cushioning member 636B, and the second cushioning member 636B is disposed between the lower surface 641 of the first cushioning member 636A and the bottom sheet 30. The first cushioning member 636A and the second cushioning member 636B may differ in at least one of material, hardness, energy return, or density.

The method of manufacturing the strobel 612 includes arranging the first cushioning member 636A and the second cushioning member 636B so that at least a portion of the first cushioning member 636A overlies the second cushioning member 636B in the completed strobel 612 as shown. With reference to FIG. 6, for example, instead of the cushioning member 36, the second cushioning member 636B would first be placed on the lower sheet 30 (along with the third cushioning member 636C, if present) so that the second cushioning member 636B interfaces with the inner surface 34 of the lower sheet 30, and then the first cushioning member 636A would be placed on the lower sheet 30 with a portion of the first cushioning member 636A overlying the second cushioning member 636B, another portion of the first cushioning member 636A overlying the third cushioning member 636C, if present, and still another portion of the first cushioning member 636A directly on the inner surface 34 of the lower sheet 30. The top sheet 28 will be placed over the first cushioning member 636A so that the first cushioning member 636A interfaces with the inner surface 32 of the top sheet 28. Placing the first cushioning member 636A and the second cushioning member 636B relative to one another in this manner interfits the first cushioning member 636A with the second cushioning member 636B in the cavity 26 of the formed strobel 612 so that a first portion of an inner surface of the casing 24 (e.g., the inner surface 32 of the top sheet 28 as well as the portion of the inner surface of the bottom sheet 30 that directly underlies the first cushioning member 636A) interfaces with the first cushioning member 636A, and a second portion of the inner surface of the casing 24 (e.g., another portion of the inner surface 34 of the bottom sheet 30 (the portion that directly underlies the second cushioning member 636B) interfaces with the second cushioning member 636B.

Figure 26:
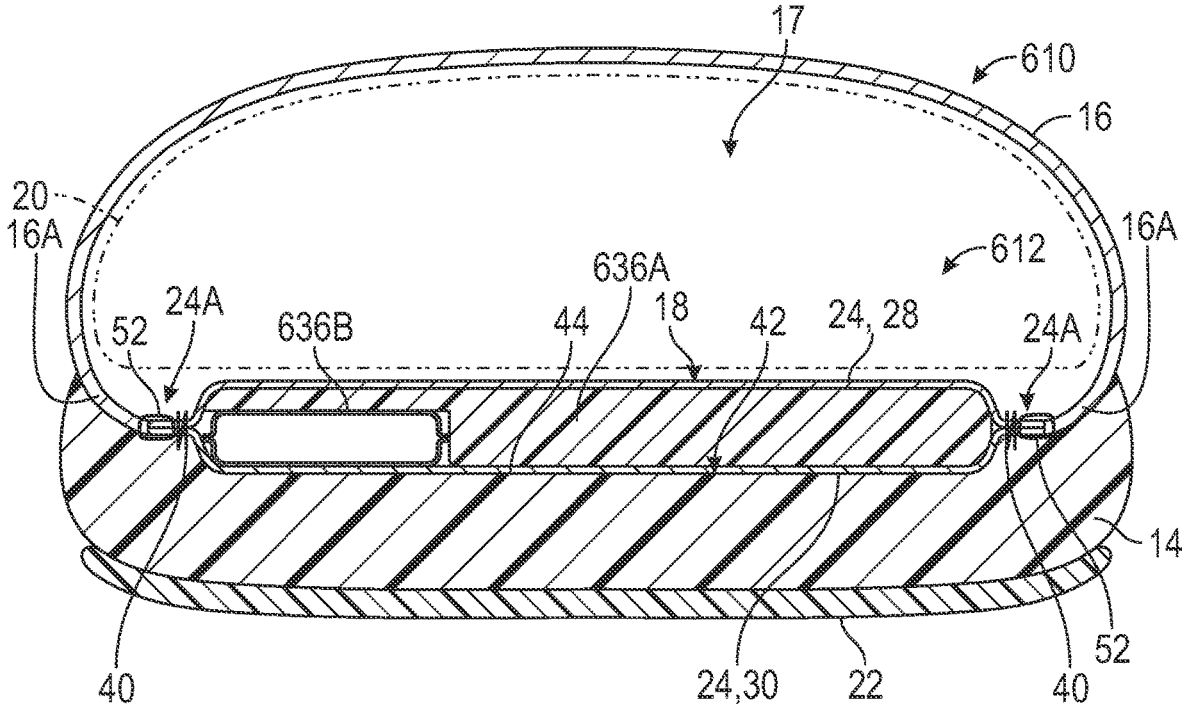
FIG. 26 is a cross-sectional illustration of an article of footwear including the strobel of FIG. 25 taken at lines 26-26 of the strobel in FIG. 25.

FIG. 26 is a cross-sectional illustration of an article of footwear 610 including the strobel 612 of FIGS. 24-25. Except for the arrangement of both first and second cushioning members 636A and 636B (and the third cushioning member 636C, if present), the article of footwear 610 is manufactured in the same manner as described with respect to the article of footwear 10 of FIG. 4 and the article of footwear 110 of FIG. 15 except using strobel 612 instead of strobel 12 or strobel 112, with the exterior surface 18 of the top sheet 28 being the foot-contact surface within the void 17. The article of footwear 610 is characterized by the absence of an insole.

Figure 27:
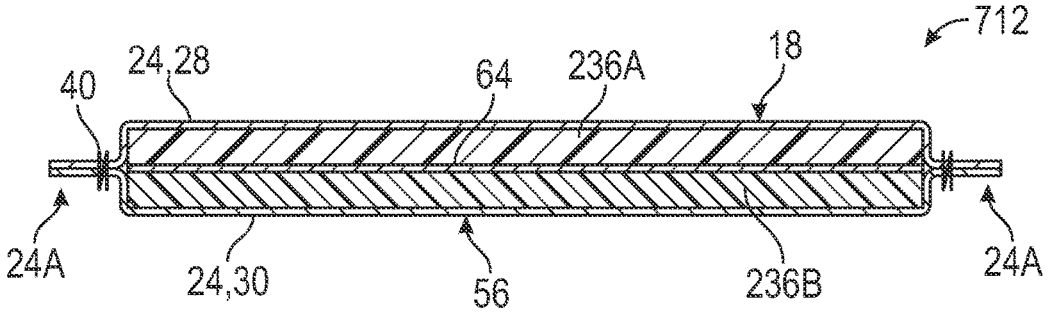
FIG. 27 is a cross-sectional illustration of another example of a strobel including a casing and a cushioning member.

FIG. 27 is a cross-sectional illustration of another example of a strobel 712 including the casing 24 as described with respect to FIGS. 1-4, including both the first cushioning member 236A and the second cushioning member 236B described with respect to FIG. 16 (e.g., foam cushioning members), and further including a plate 64 disposed between the first cushioning member 236A and the second cushioning member 236B.

The plate 64 may be a relatively rigid material. Non-limiting examples of materials suitable for the plate 64 include any one of a carbon fiber composite, spring steel, fiberglass, nylon, a thermoplastic elastomer, such as polyether block amide, or a superelastic metal including nitinol. One example polyether block amide is commercially available under the tradename PEBAX®, from ARKEMA Inc. in King of Prussia, Pennsylvania USA.

The plate 64 may be relatively flat, or may be pre-formed with some amount of curvature and variations in thickness when molded or otherwise formed in order to provide a shaped footbed and/or increased thickness for reinforcement in desired areas. For example, the plate 64 could have a curved or contoured geometry that may be similar to the lower contours of the foot 20.

The first cushioning member 236A overlies the plate 64 and the plate 64 overlies the second cushioning member 236B. The first cushioning member 236A overlies the second cushioning member 236B indirectly through the plate 64. The plate 64 is disposed within the cavity 26 and overlies the second cushioning member 236B so that the plate 64 is between the foot contact surface 18 of the strobel 712 and the second cushioning member 236B, and the second cushioning member 236B is between the plate 64 and the bottom exterior surface 56 of the casing 24. The first cushioning member 236A is between the plate 64 and the foot contact surface 18 of the strobel 712. The plate 64 may extend over the same regions as the first and second cushioning members 236A, 236B. For example, each may be full length, extending in the forefoot region 19, the midfoot region 21, and the heel region 23, or may extend only in one of the regions 19, 21, or 23, or may extend in any two adjacent ones of the regions 19, 21, and 23. The plate 64 is less compressible than either of the cushioning members 236A, 236B and serves to distribute loading forces and reaction forces over the width and length of the second cushioning member 236B and the first cushioning member 236A with which it interfaces. For example, forces exerted on the plate 64 through the first cushioning member 236A are dispersed by the plate 64 over the entire upper surface of the second cushioning member 236B. Forces associated with return energy exerted on the plate 64 by the underlying cushioning member 236B are dispersed over the entire lower surface of the first cushioning member 236A interfacing with the plate 64.

Figure 28:
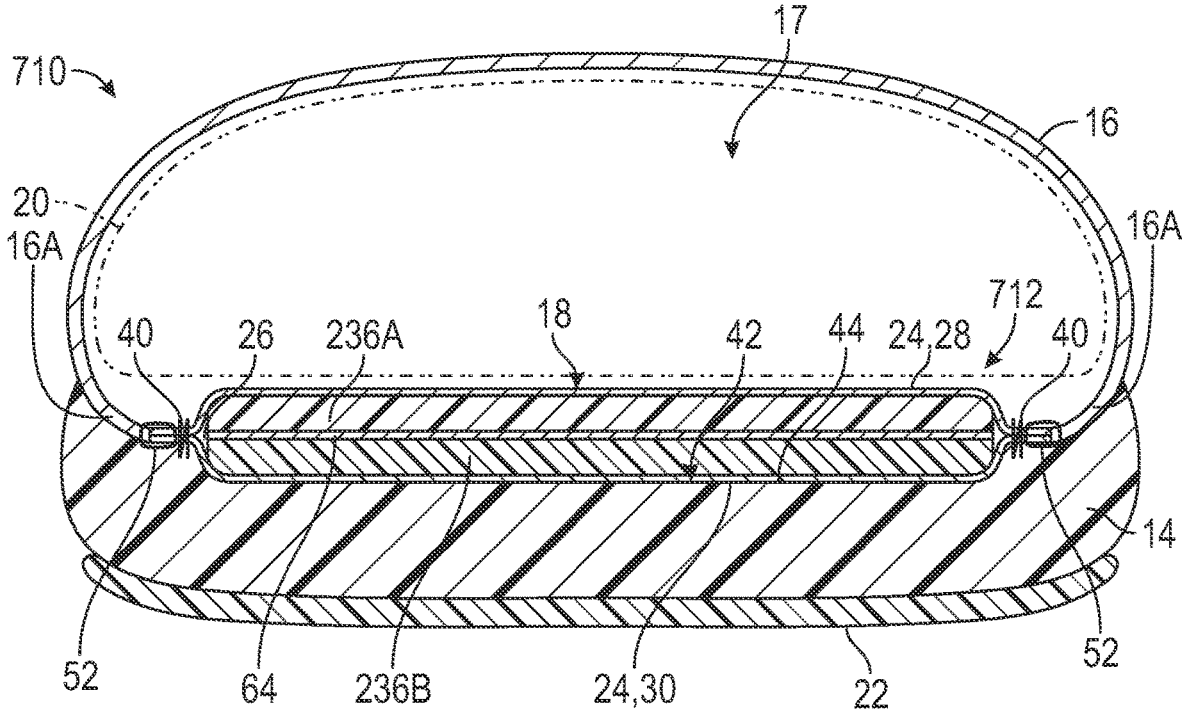
FIG. 28 is a cross-sectional illustration of an article of footwear including the strobel of FIG. 27.

Accordingly, when the strobel 712 is secured to the lower perimeter 16A of the upper 16 in the article of footwear 710 of FIG. 28 with at least the second cushioning member 236B partially nested in the recess 44, loading forces of the foot 20 that may be localized (e.g., more force applied in the medial forefoot region) will cause the cushioning members 236A, 236B to resiliently compress, but will tend to be spread over a greater surface area of the cushioning members 236A, 236B than where applied by the foot 20 due to the plate 64.

The article of footwear 710 is manufactured in the same as described with respect to the article of footwear 10 of FIG. 4, with the exterior surface 18 of the top sheet 28 being the foot-contact surface within the void 17, except using strobel 712 instead of strobel 12. As shown in FIG. 27, the 7 cushioning members 236A, 236B and the plate 64 are disposed entirely inward of the peripheral flange 24A and the stitching 40, 52, with the top and bottom sheets 28, 30 of the casing 24 in direct contact with one another at the flange 24A. The lower perimeter 16A of the upper 16 is secured to the peripheral flange 24A of the strobel 712, the upper 16 and the strobel 712 defining a foot-receiving void 17 of the article of footwear 710, with the exterior surface 18 of the casing 24 being a foot contact surface of the strobel 712 within the foot-receiving void 17, and the article of footwear 710 characterized by the absence of an insole. The upper surface 42 of the midsole 14 defines the recess 44, and the strobel 712 rests on the upper surface 42 of the midsole 14 in the recess 44 such that at least a portion of the second cushioning member 236B is disposed in the recess 44 and below the peripheral flange 24A.

Forming the strobel 712 includes arranging the first cushioning member 236A and the second cushioning member 236B so that the first cushioning member 236A is disposed between the foot contact surface 18 of the strobel 712 and the second cushioning member 236B. Forming the strobel 712 further includes disposing the plate 64 within the cavity 26 so that the plate 64 is between the foot contact surface 18 of the strobel 712 and the second cushioning member 236B, and the second cushioning member 236B is between the plate 64 and the bottom exterior surface 56 of the casing 24.

Figure 29:
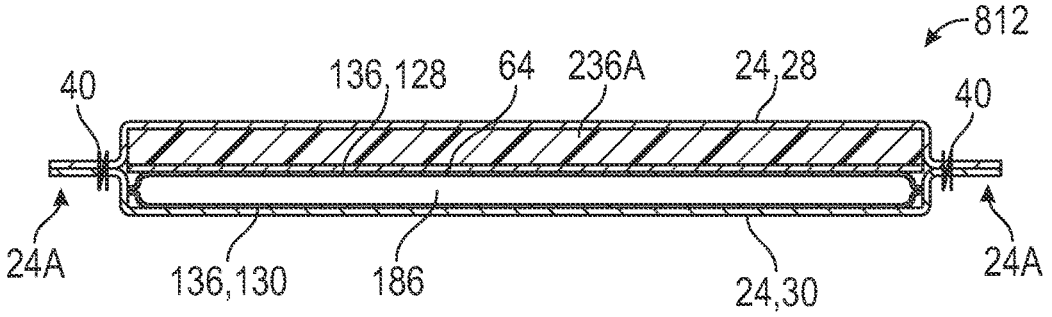
FIG. 29 is a cross-sectional illustration of another example of a strobel including a casing and a cushioning member.

FIG. 29 is a cross-sectional illustration of another example of a strobel 812. The strobel 812 is identical to the strobel 712 except that the cushioning member 136 of FIG. 14 (e.g., a fluid-filled chamber) is used as the second cushioning member in place of cushioning member 236B. The second cushioning member 136 may be pressurized with fluid in the cavity 186 to provide a different compressibility and energy return than the cushioning member 236A.

Figure 30:
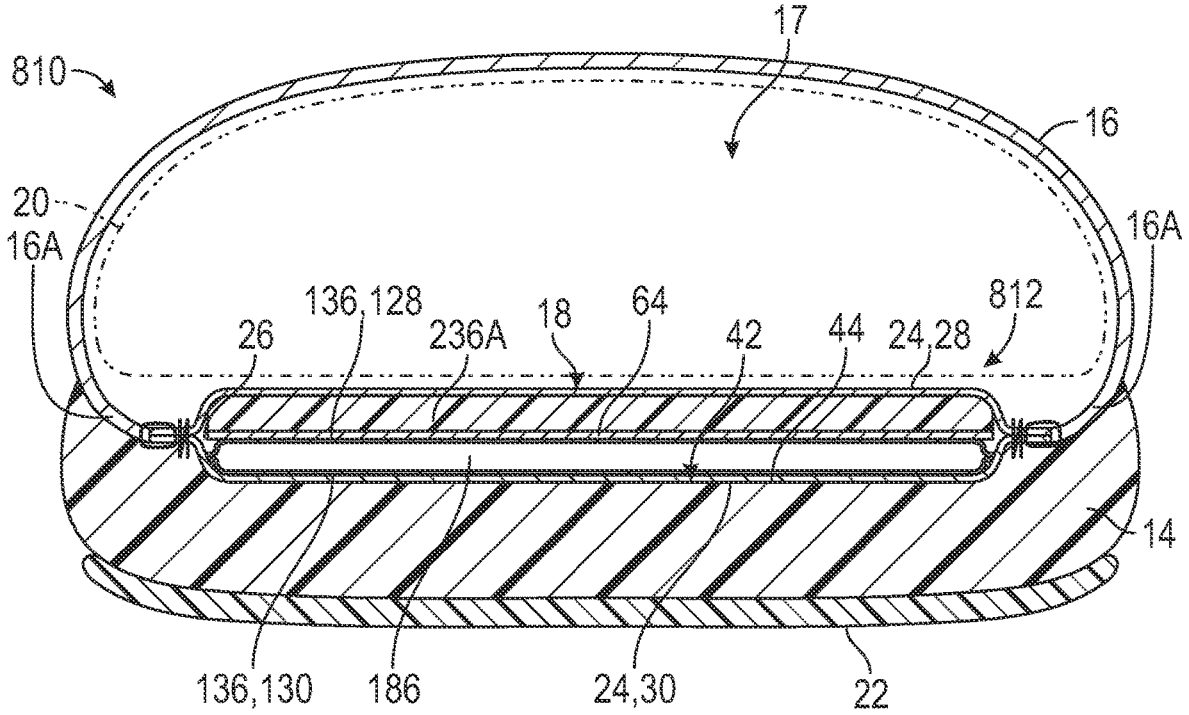
FIG. 30 is a cross-sectional illustration of an article of footwear including the strobel of FIG. 29.

FIG. 30 is a cross-sectional illustration of an article of footwear 810 including the strobel 812 of FIG. 29. The article of footwear 810 is manufactured in the same manner as described with respect to the article of footwear 10 of FIG. 4, except using strobel 812 instead of strobel 12, and with the exterior surface 18 of the top sheet 28 being the foot-contact surface within the void 17, and the article of footwear 810 is characterized by the absence of an insole. The upper surface 42 of the midsole 14 defines the recess 44, and the strobel 812 rests on the upper surface 42 of the midsole 14 in the recess 44 such that at least a portion of the second cushioning member 136 is disposed in the recess 44 and below the peripheral flange 24A.

Figure 31:
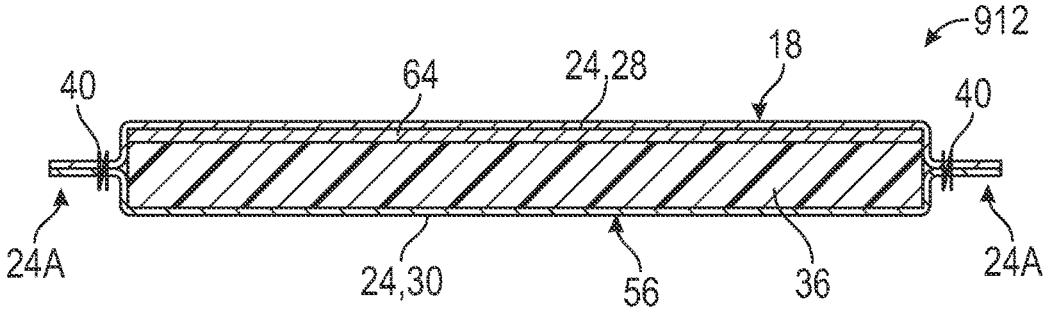
FIG. 31 is a cross-sectional illustration of another example of a strobel including a casing and a cushioning member.

FIG. 31 is a cross-sectional illustration of another example of a strobel 912. The strobel 912 is identical to the strobel 12 of FIG. 2 except that the plate 64 is included in the casing 24, overlying the cushioning member 36. The plate 64 is disposed within the cavity 26 and overlies the cushioning member 36 so that the plate 64 is between the foot contact surface 18 of the strobel 912 and the cushioning member 36, and the cushioning member 36 is between the plate 64 and the bottom exterior surface 56 of the casing 24. The plate 64 may extend over the same regions as the cushioning member 36. For example, each may be full length, extending in the forefoot region 19, the midfoot region 21, and the heel region 23, or may extend only in one of the regions, 19, 21, or 23, or may extend in any two adjacent ones of the regions 19, 21, and 23. The plate 64 is less compressible than the cushioning member 36 and serves to distribute loading forces and reaction forces over the width and length of the cushioning member 36 with which it interfaces.

Figure 32:
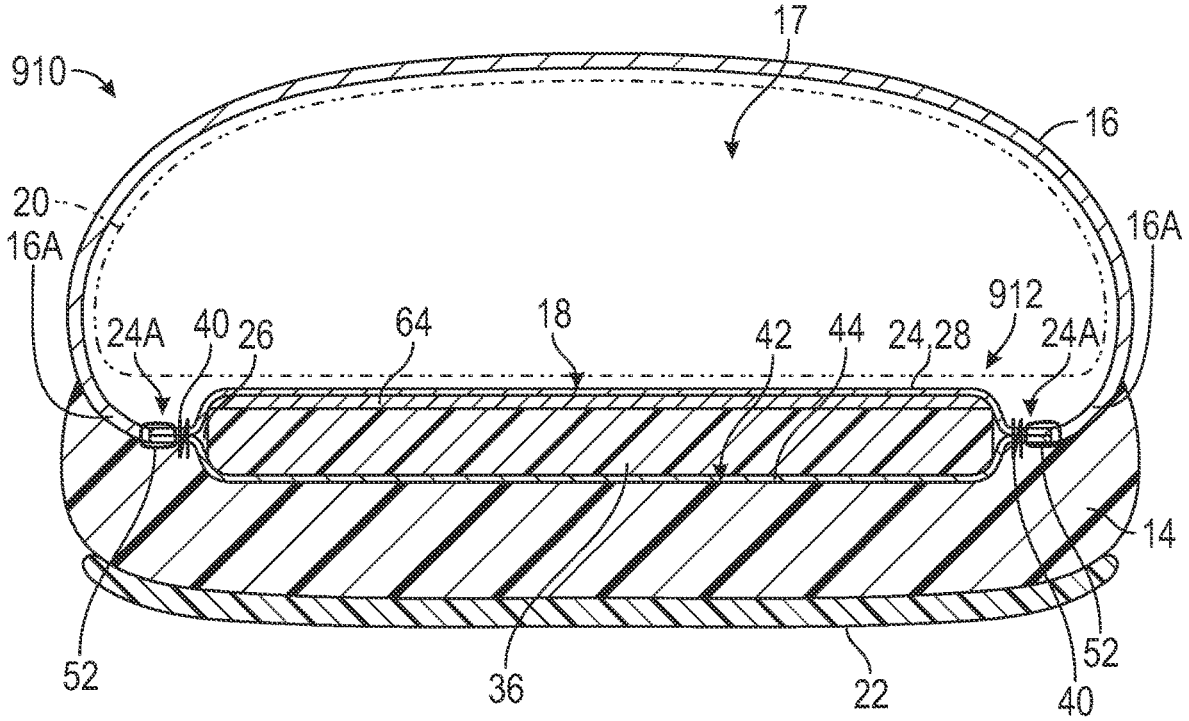
FIG. 32 is a cross-sectional illustration of an article of footwear including the strobel of FIG. 31.

FIG. 32 is a cross-sectional illustration of an article of footwear 910 including the strobel 912 of FIG. 31. The article of footwear 910 is manufactured in the same manner as described with respect to the article of footwear 10 of FIG. 4, using the casing 24 as described with respect to FIGS. 1-4, and the cushioning member 36 described with respect to FIG. 2 (e.g., foam cushioning member), and further including the plate 64 disposed between the top sheet 28 of the casing 24 and the cushioning member 36, with the exterior surface 18 of the top sheet 28 being the foot-contact surface within the void 17 as the article of footwear 910 is characterized by the absence of an insole. The upper surface 42 of the midsole 14 defines the recess 44, and the strobel 912 rests on the upper surface 42 of the midsole 14 in the recess 44 such that at least a portion of the cushioning member 36 is disposed in the recess 44 and below the peripheral flange 24A.

Figure 33:
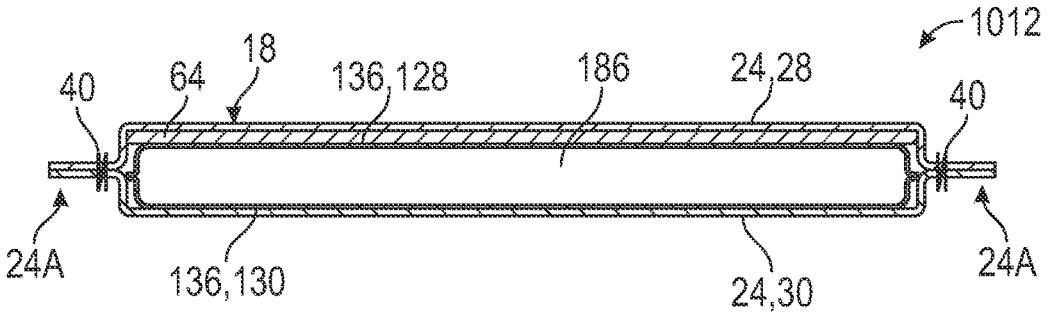
FIG. 33 is a cross-sectional illustration of another example of a strobel including a casing and a cushioning member.

FIG. 33 is a cross-sectional illustration of another example of a strobel 1012. The strobel 1012 is identical to the strobel 912 except that the cushioning member 136 of FIG. 14 (e.g., a fluid-filled chamber) is used in place of cushioning member 36. The interior cavity 186 may be inflated so that the cushioning member 136 is pressurized to provide a different compressibility and energy return than the cushioning member 36.

Figure 34:
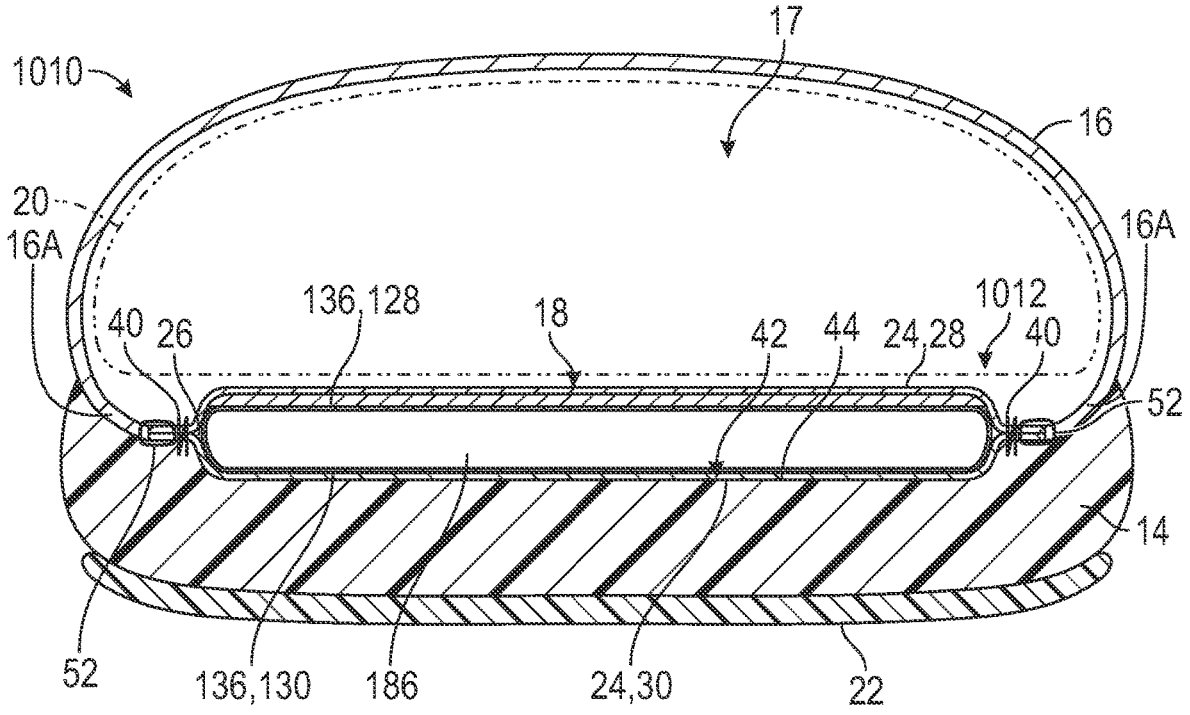
FIG. 34 is a cross-sectional illustration of an article of footwear including the strobel of FIG. 33.

FIG. 34 is a cross-sectional illustration of an article of footwear 1010 including the strobel 1012 of FIG. 33. The article of footwear 1010 is manufactured in the same manner as described with respect to the article of footwear 10 of FIG. 4, except using strobel 1012 instead of strobel 12, and with the exterior surface 18 of the top sheet 28 being the foot-contact surface within the void 17, and the article of footwear 1010 characterized by the absence of an insole. The upper surface 42 of the midsole 14 defines the recess 44, and the strobel 1012 rests on the upper surface 42 of the midsole 14 in the recess 44 such that at least a portion of the cushioning member 136 is disposed in the recess 44 and below the peripheral flange 24A.

Figure 35:
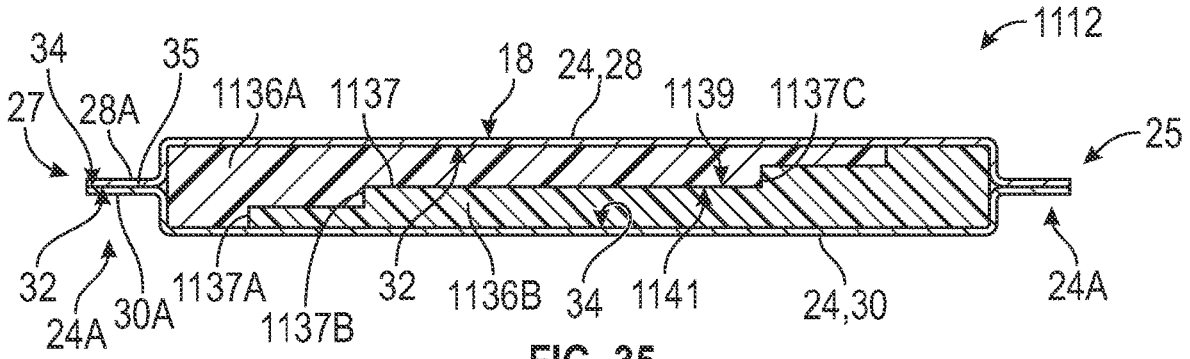
FIG. 35 is a cross-sectional illustration of another example of a strobel taken at lines 35-35 in FIG. 36, including a casing, a first cushioning member, and a second cushioning member.

FIG. 35 is a cross-sectional illustration of another example of a strobel 1112 including the casing 24 as described with respect to FIGS. 1-4, and including both a first cushioning member 1136A and a second cushioning member 1136B in place of the single cushioning member 36. Like the strobel 12A in FIG. 3, the periphery 28A of the top sheet 28 is secured to the periphery 30A of the bottom sheet 30 at the interface 35 of the inner surfaces 32, 34 of the sheets 28, 30 with adhesive, thermal bonding, and/or due to compression molding, and without any stitching used to secure the sheets 28, 30 to one another at the peripheral flange 24A (e.g., without the first series of stitches 40). Alternatively or in addition, stitching with the first series of stitches 40 shown in FIG. 1 could be used.

Figure 36:
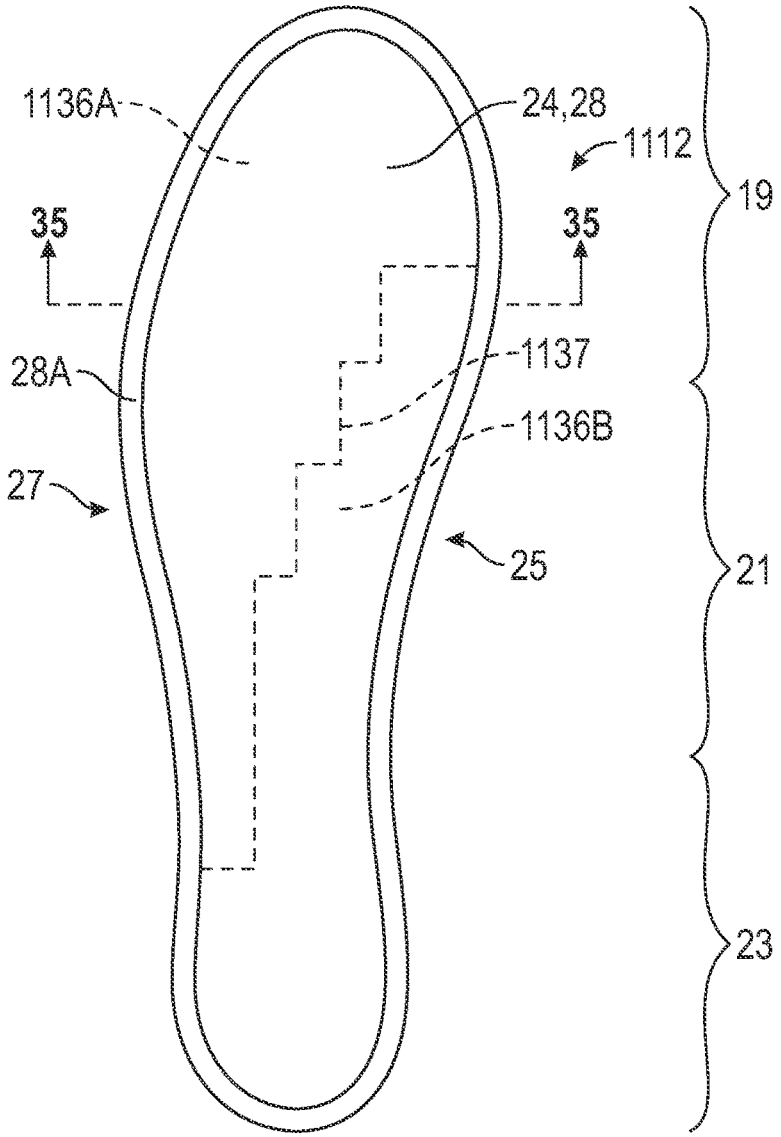
FIG. 36 is a plan view of the strobel of FIG. 35.

At least a portion of the first cushioning member 1136A overlies the second cushioning member 1136B. The cushioning members 1136A, 1136B are irregularly shaped with a stepped interface 1137. As shown in FIGS. 35-36, the first cushioning member 1136A decreases in height in a direction from the lateral side 27 to the medial side 25 while the second cushioning member 1136B increases in height in a direction from the lateral side 27 to the medial side 25. The lower surface 1141 of the first cushioning member 1136A and the upper surface 1139 of the second cushioning member 1136B are stepped in an identical manner in order to accommodate the decreases in height in a direction from the lateral side 27 to the medial side 25 of the first cushioning member 1136A and the increase in height in a direction from the lateral side 27 to the medial side 25 of the second cushioning member 1136B so that the cushioning members 1136A, 1136B interfit with one another without gaps at the stepped interface 1137. The stepped interface 1137 includes a series of vertical steps 1137A, 1137B, and 1137C. The interface 1137 of the first and second cushioning members 1136A, 1136B is only one non-limiting example, and the cushioning members 1136A, 1136B may instead have different shapes in the X, Y, and Z directions than shown.

As shown in FIG. 36, the first cushioning member 1136A is not a full length cushioning member, as it extends in the forefoot region 19 and the midfoot region 21, but only partially in the heel region 23. The second cushioning member 1136B is also not full length, extending in the heel region 23 and the midfoot region 21, but only partially in the forefoot region 19. In this arrangement, the cushioning members 1136A, 1136B interfit so that a first portion of a top inner surface of the casing 24 (e.g., the inner surface 32 of the top sheet 28) interfaces with the first cushioning member 1136A, and a second portion of the top inner surface of the casing 24 (e.g., another portion of the inner surface 32 of the top sheet 28) interfaces with the second cushioning member 1136B. Additionally, both the first and second cushioning members 1136A, 1136B interface with the inner surface 34 of the bottom sheet 30 of the casing 24. In some locations, the height of the strobel 1112 is thus dependent upon the thickness of the first cushioning member 1136A and the thickness of the second cushioning member 1136B at the cross section shown, where thickness is in the Z direction (vertically in the view shown), while at other locations (e.g., near the medial and lateral sides), the height of the strobel 1112 is dependent on only the first cushioning member 1136A but not the second cushioning member 1136B, or on the second cushioning member 1136B but not the first cushioning member 1136A.

Figure 37:
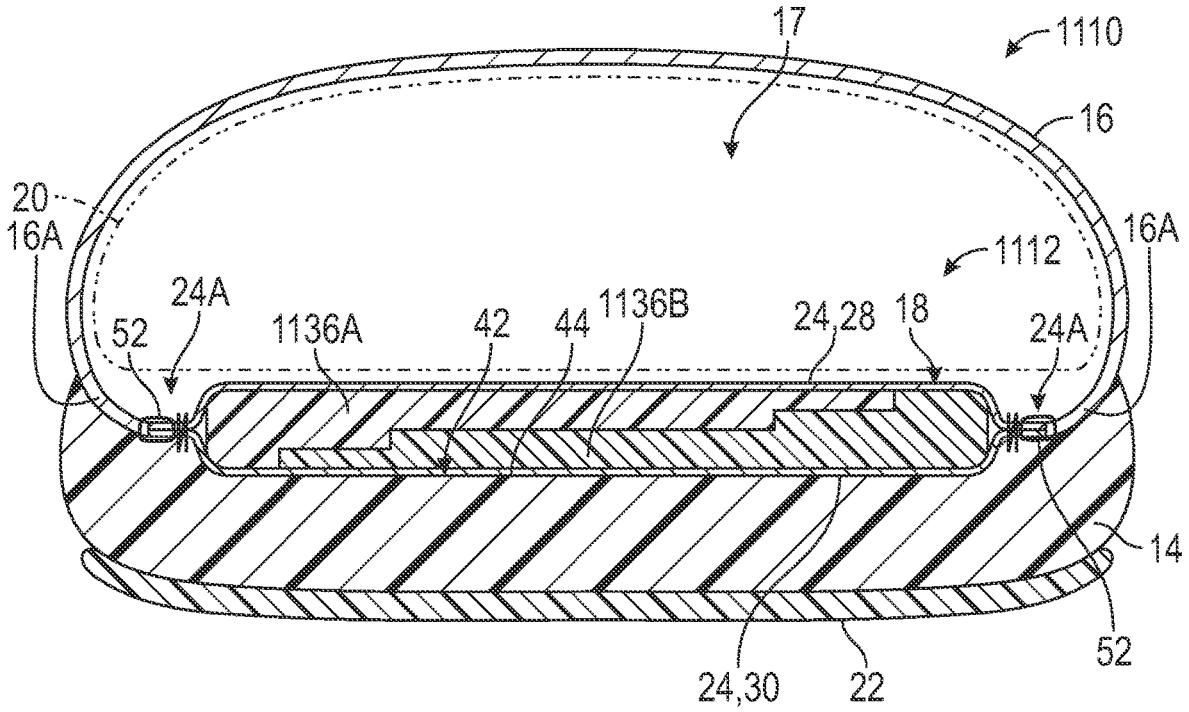
FIG. 37 is a cross-sectional illustration of an article of footwear including the strobel of FIGS. 35-36.

As shown in FIGS. 35 and 37, at portions of the cushioning members 1136A, 1136B where they contact one another at the interface 1137, the first cushioning member 1136A is disposed between the foot contact surface 18 of the strobel 1112 and the second cushioning member 1136B. More specifically, the cushioning member 1136A is disposed between the top sheet 28 of the casing 24 and the upper surface 1139 of the second cushioning member 1136B, and the second cushioning member 1136B is disposed between the lower surface 1141 of the first cushioning member 1136A and the bottom sheet 30.

The first cushioning member 1136A and the second cushioning member 1136B may differ in at least one of material, hardness, energy return, or density. For example, both the first cushioning member 1136A and the second cushioning member 1136B may include a different foam material and may have a different hardness, energy return, or density. In one example, the second cushioning member 1136B may be a foam material with a greater hardness than that of the first cushioning member 1136A such as to provide greater support at the medial side 25 of the strobel 1112 to help prevent pronation.

The method of manufacturing the strobel 1112 includes arranging the first cushioning member 1136A and the second cushioning member 1136B so that at least a portion of the first cushioning member 1136A overlies the second cushioning member 1136B in the completed strobel 1112. The cushioning members 1136A, 1136B could first be interfit in this manner and then placed together on the surface 34 of the lower sheet 30, or either cushioning member 1136A, 1136B could be placed on the bottom sheet 30 in FIG. 6, then the other cushioning member 1136A, 1136B could be interfit with the cushioning member 1136A or 1136B already on the bottom sheet 30 before placing the top sheet 28 over the first cushioning member 1136A and the second cushioning member 1136B so that both cushioning members 1136A, 1136B interface with the inner surfaces 32, 34 of both the top sheet 28 and the bottom sheet 30.

Forming the strobel 1112 includes arranging the first cushioning member 1136A and the second cushioning member 1136B so that the first cushioning member 1136A is disposed between the foot contact surface 18 of the strobel 1112 and the second cushioning member 1136B where the cushioning members 1136A, 1136B interface.

FIG. 37 is a cross-sectional illustration of an article of footwear 1110 including the strobel 1112 of FIG. 35. The article of footwear 1110 is manufactured in the same manner as described with respect to the article of footwear 10 of FIG. 4, except using strobel 1112 instead of strobel 12, and with the exterior surface 18 of the top sheet 28 being the foot-contact surface within the void 17, and the article of footwear 1110 is characterized by the absence of an insole. The upper surface 42 of the midsole 14 defines the recess 44, and the strobel 1112 rests on the upper surface 42 of the midsole 14 in the recess 44 such that at least a portion of the cushioning member 1136B is disposed in the recess 44 and below the peripheral flange 24A. As shown in FIG. 37, at least a portion of the cushioning member 1136B is also disposed in the recess 44 and below the peripheral flange 24A. The cushioning members 1136A, 1136B are disposed entirely inward of the peripheral flange 24A and the stitching 52, with the top and bottom sheets 28, 30 of the casing 24 in direct contact with one another at the peripheral flange 24A. The lower perimeter 16A of the upper 16 is secured to the peripheral flange 24A of the strobel 1112, the upper 16 and the strobel 1112 defining the foot-receiving void 17 of the article of footwear 1110, with the exterior surface 18 of the casing 24 being a foot contact surface of the strobel 1112.

Figure 38:
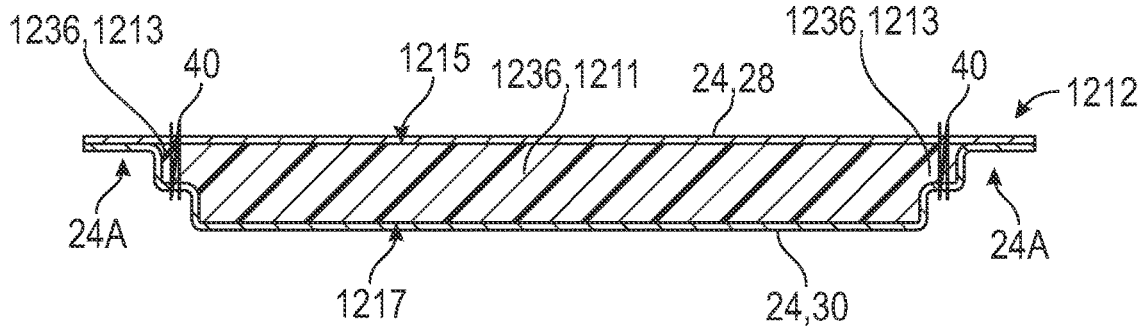
FIG. 38 is a cross-sectional illustration of another example of a strobel including a casing and a cushioning member.

FIG. 38 is a cross-sectional illustration of another example of a strobel 1212 including the casing 24 and at least one cushioning member 1236. The cushioning member 1236 may be a unitary foam cushioning member configured with a central portion 1211 and a peripheral flange portion 1213 surrounding and extending outward from the central portion 1211. The central portion 1211 is thicker than the peripheral flange portion 1213 and the peripheral flange portion 1213 is vertically offset such that it is nearer to a top surface 1215 of the central portion 1211 than to a bottom surface 1217 of the central portion 1211. The cushioning member 1236 may thus be referred to as T-shaped in cross section.

The strobel 1212 may be manufactured by stitching the casing 24 to the cushioning member 1236 with the series of stitches 40 (also referred to as stitching) extending through the peripheral flange portion 1213 of the cushioning member 1236 and with the sheets 28, 30 secured to one another and with the peripheral flange 24A of the casing 24, the stitching 40 joining the peripheral flange portion 1213 of the unitary foam cushioning member 1236 to the peripheral flange 24A of the casing 24.

Configuring the cushioning member 1236 with the central portion 1211 and the flange portion 1213 as described (such as by injection molding the cushioning member 1236 or cutting a foam slab) enables the peripheral flange 24A of the casing 24 to be closer to the top surface 1215 than to the bottom surface 1217. The central portion 1211 can extend down into the recess 44, resting on the upper surface 42 of the midsole 14, while the flange portion 1213 enables the top sheet 28 of the casing 24 to remain relatively flat even at the peripheral flange 24A, without dipping downward at the peripheral flange 24A. Accordingly, little or no change in elevation of the strobel 1212 is apparent at the foot contact surface 18 in comparison to an embodiment in which the peripheral flange 24A is vertically centered rather than offset vertically upward as it is in FIG. 39.

Figure 39:
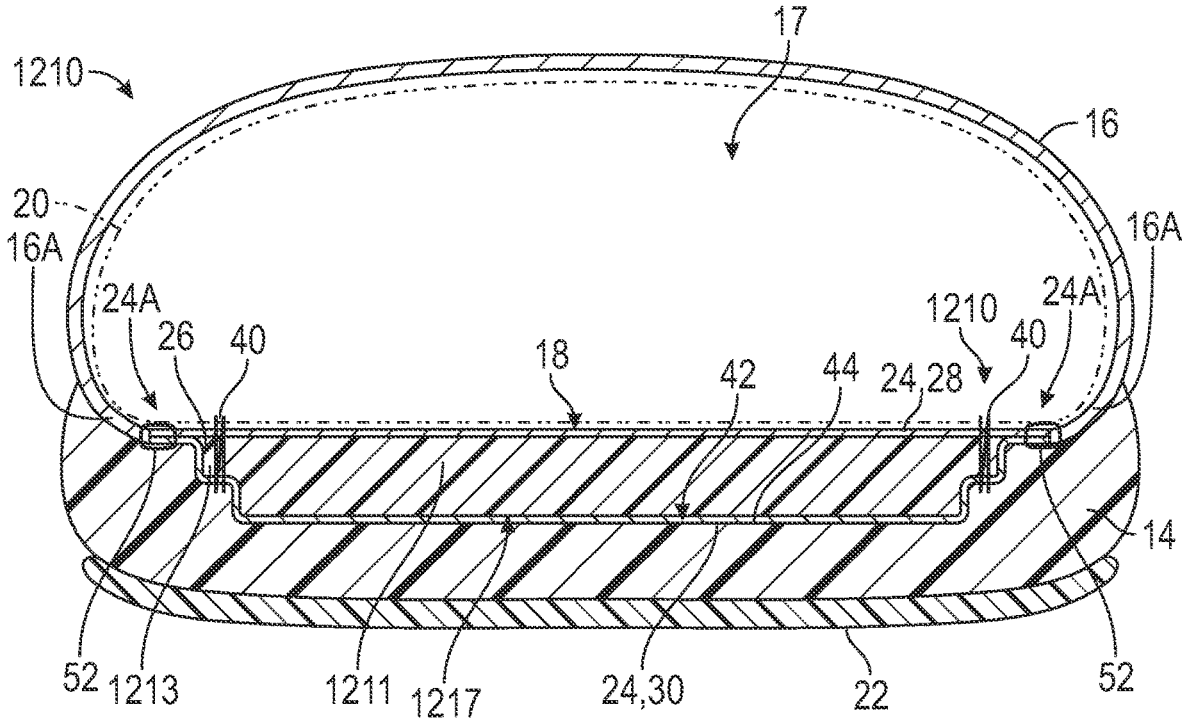
FIG. 39 is a cross-sectional illustration of an article of footwear including the strobel of FIG. 38.

FIG. 39 is a cross-sectional illustration of an article of footwear 1210 including the strobel 1212 of FIG. 38. The article of footwear 1210 is manufactured in the same manner as described with respect to the article of footwear 10 of FIG. 4, except using strobel 1212 instead of strobel 12. The exterior surface 18 of the top sheet 28 is the foot-contact surface within the void 17 as the article of footwear 1210 is characterized by the absence of an insole. The upper surface 42 of the midsole 14 defines the recess 44, and the strobel 1212 rests on the upper surface 42 of the midsole 14 in the recess 44 such that at least a portion of the cushioning member 1236 is disposed in the recess 44 and below the peripheral flange 24A. The portion of the cushioning member 1236 disposed in the recess 44 and below the peripheral flange 24A is a lower extent of the central portion 1211. The entire cushioning member 1236 is disposed inward of the flange 24A and stitching 52 secures the flange 24A to the lower perimeter 16A of the upper 16, with the top and bottom sheets 28, 30 of the casing 24 in direct contact with one another at the peripheral flange 24A. The upper 16 and the strobel 1212 define the foot-receiving void 17 of the article of footwear 1210, with the exterior surface 18 of the casing 24 being a foot contact surface of the strobel 1212.

Figure 40:
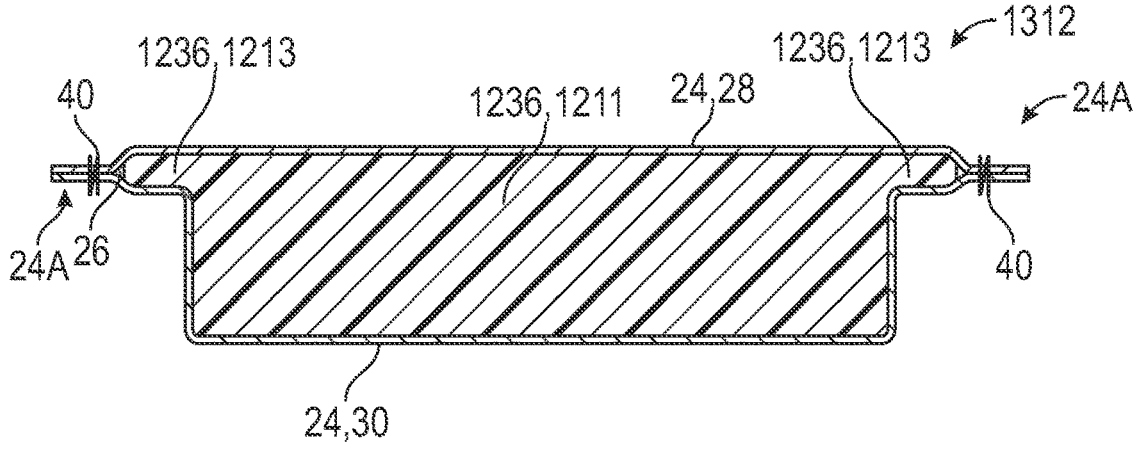
FIG. 40 is a cross-sectional illustration of another example of a strobel including a casing and a cushioning member.
Figure 41:
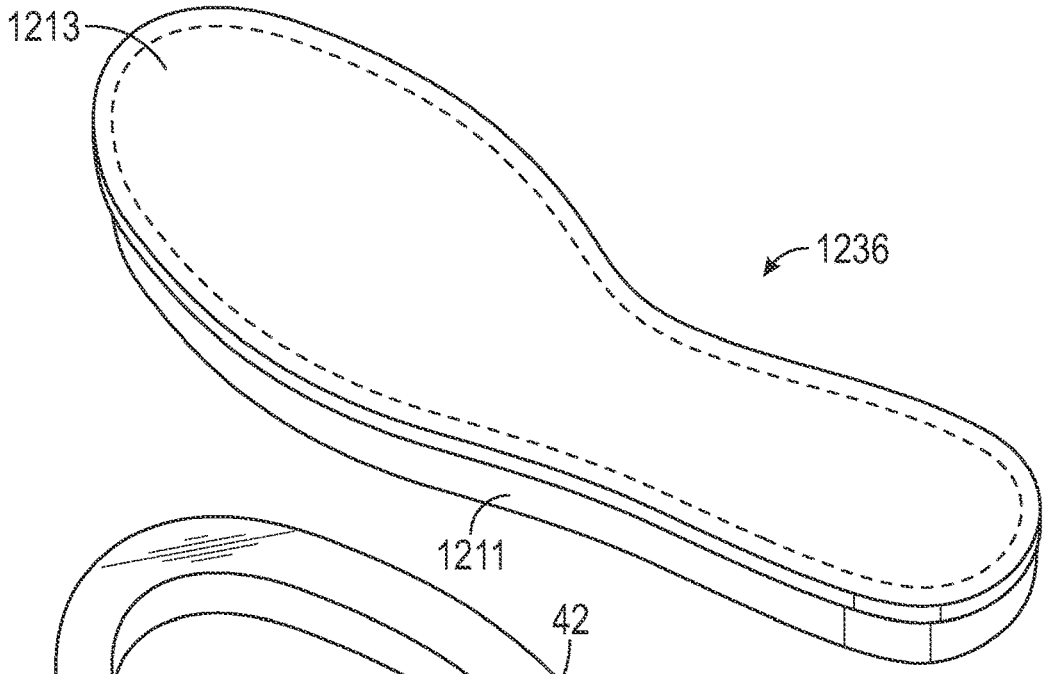
FIG. 41 is a perspective view of the cushioning member of the strobel of FIG. 40.
Figure 42:
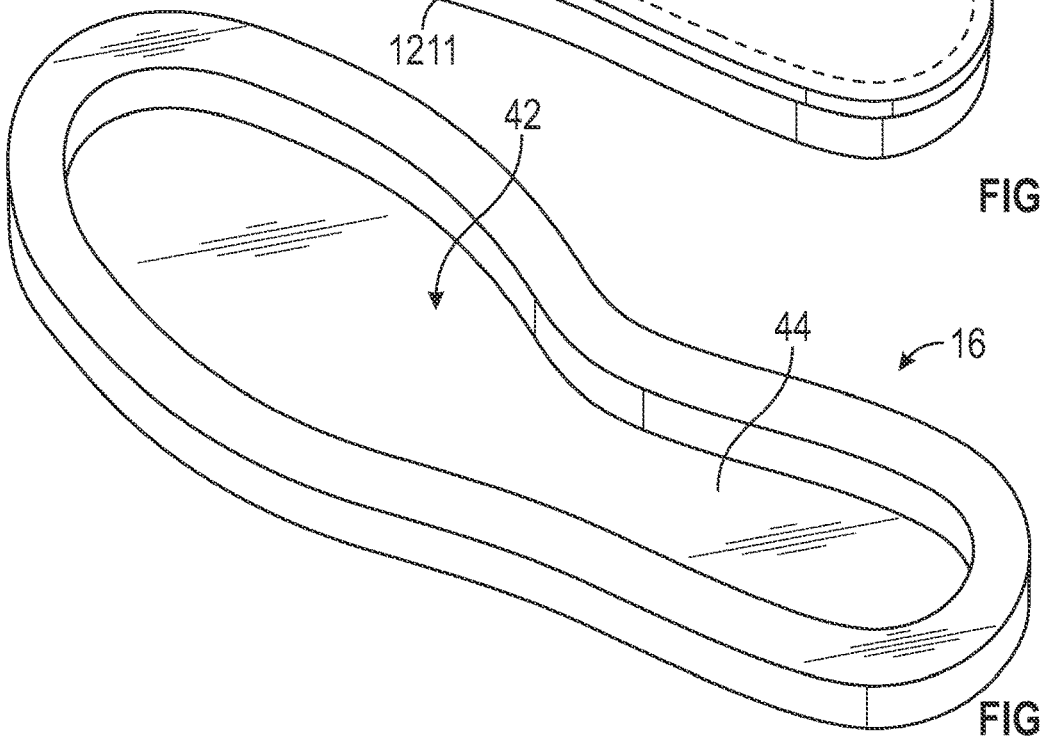
FIG. 42 is a perspective view of a midsole.
Figure 43:
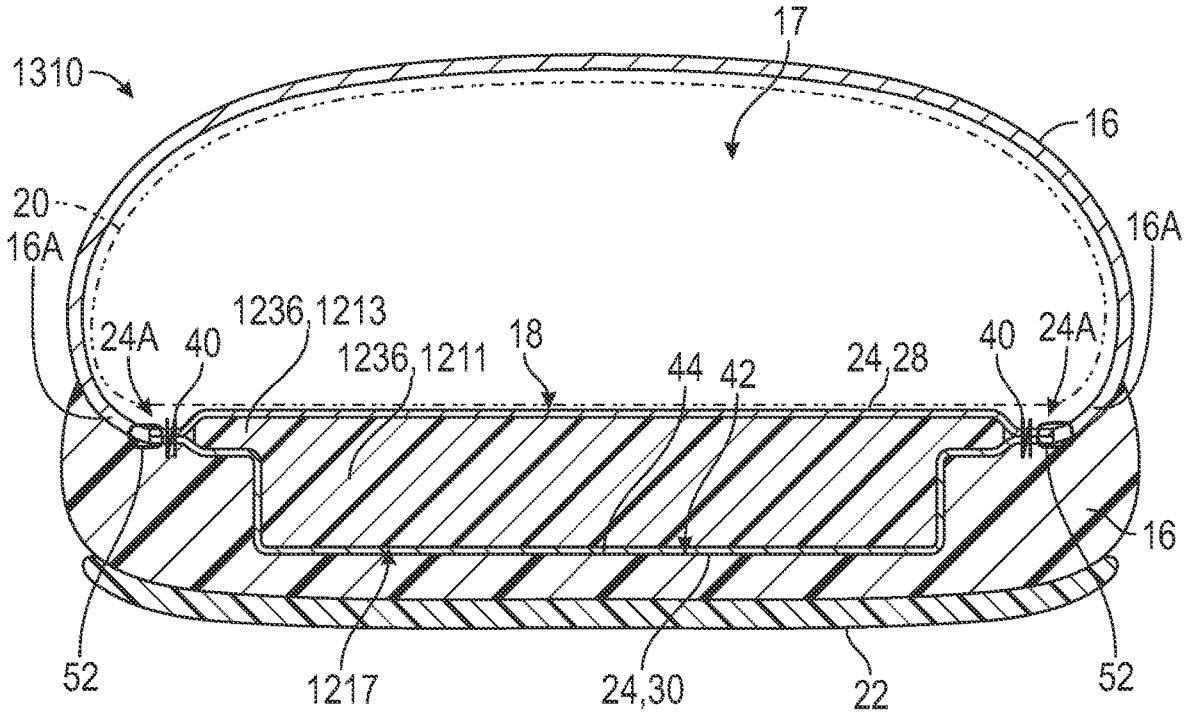
FIG. 43 is a cross-sectional illustration of an article of footwear including the strobel of FIG. 40 and the midsole of FIG. 42.

FIG. 40 is a cross-sectional illustration of another example of a strobel 1312 including the casing 24 and the cushioning member 1236. The strobel 1312 is identical to strobel 1212 except that the series of stitches 40 extend only through the top and bottom sheets 28, 30 of the casing 24 at the peripheral flange 24A and not through the flange portion 1213 of the cushioning member 1236. FIG. 41 shows the cushioning member 1236, indicating that the peripheral flange portion 1213 extends around an entire periphery of the cushioning member 1236. FIG. 42 shows the midsole 14 with the recess 44. It is apparent from FIGS. 41 and 42 that the central portion 1211 fits in the recess 44 and the peripheral flange portion 1213 will be spaced above and outward of the recess 44 and also supported on the midsole 14. As shown in FIG. 43, the midsole 14 underlies the bottom surface 1217 of the central portion 1211 of the unitary foam cushioning member 1236 with the bottom sheet 30 therebetween. The midsole 14 interfaces with and underlies the casing 24 below the bottom surface 1217 of the central portion 1211 of the unitary foam cushioning member 1236.

FIG. 43 is a cross-sectional illustration of an article of footwear 1310 including the strobel 1312 of FIG. 40. The article of footwear 1310 is manufactured in the same manner as described with respect to the article of footwear 10 of FIG. 4, except using strobel 1312 instead of strobel 12. The exterior surface 18 of the top sheet 28 is the foot-contact surface within the void 17 as the article of footwear 1310 is characterized by the absence of an insole. The strobel 1312 rests on the upper surface 42 of the midsole 14 in the recess 44 such that at least a lower extent of the cushioning member 1236 is disposed in the recess 44 and below the peripheral flange 24A. The cushioning member 1236 is disposed entirely inward of the flange 24A and stitching 52 secures the peripheral flange 24A to the lower perimeter 16A of the upper 16, with the upper and lower sheets 28, 30 of the casing 24 in direct contact with one another at the peripheral flange 24A. The upper 16 and the strobel 1312 define the foot-receiving void 17 of the article of footwear 1310, with the exterior surface 18 of the casing 24 being a foot contact surface of the strobel 1312.

Figure 44:
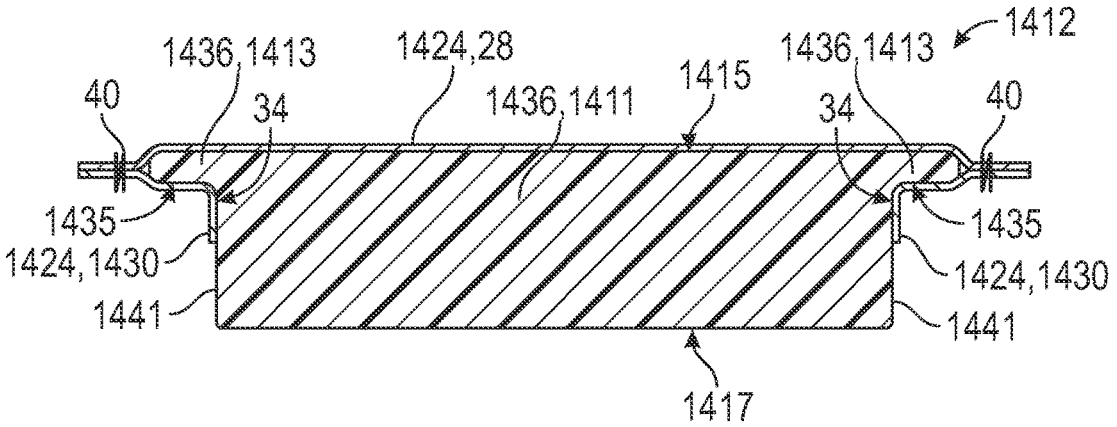
FIG. 44 is a cross-sectional illustration of another example of a strobel including a casing and a cushioning member.

FIG. 44 is a cross-sectional illustration of another example of a strobel 1412 including a casing 1424 and a cushioning member 1436. The strobel 1412 is configured similar to the strobel 1212 with the cushioning member 1436 including a central portion 1411 and a peripheral flange portion 1413 surrounding and extending outward from the central portion 1411. The cushioning member 1436 may be a unitary foam cushioning member, with the central portion 1411 thicker than the peripheral flange portion 1413 and with the peripheral flange portion 1413 vertically offset such that it is nearer to a top surface 1415 of the central portion 1411 than to a bottom surface 1417 of the central portion 1211. The cushioning member 1436 may be referred to as T-shaped in cross section.

Figure 46:
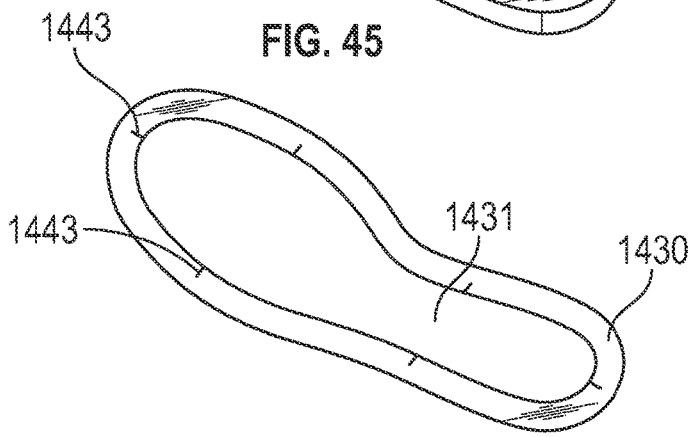
FIG. 46 is a perspective view of a bottom sheet of a casing of the strobel of FIG. 44.

The strobel 1412 includes a casing 1424 with a top sheet 28 as described, and with a bottom sheet 1430 that includes a central aperture 1431, best shown in FIG. 46. In the assembled strobel 1412, the peripheral flange 24A is entirely outward of the peripheral flange portion 1413, with the series of stitches 40 securing the top sheet 28 to the bottom sheet 1430. The central portion 1411 of the foam cushioning member 1436 extends through the central aperture 1431 and the inner surface 34 of the bottom sheet 1430 is adhered or thermally bonded to the bottom surface 1435 of the peripheral flange portion 1413 and to an upper extent (e.g., partway down) an outer wall 1441 (e.g., a side wall) of the central portion 1411. As shown in FIG. 46, the bottom sheet 1430 may have slits 1443 that enable it to conform to both the bottom surface 1435 and the outer wall 1441. Six slits 1443 are shown (only two are labelled), but there may be fewer than or more than six. The bottom sheet 1430 only extends partway down the outer wall 1441 when the casing 1424 is secured to the cushioning member 1436. The lower extent of the outer wall 1441 and a bottom surface 1417 of the central portion 1411 are thus not covered by the bottom sheet 1430, as shown in FIG. 44. Alternatively, the bottom sheet 1430 could be sized to extend down and cover the entire surface of the outer wall 1441.

Figure 45:
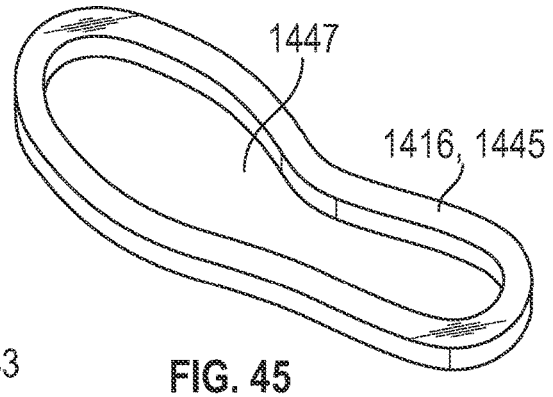
FIG. 45 is a perspective view of another example of a midsole.
Figure 47:
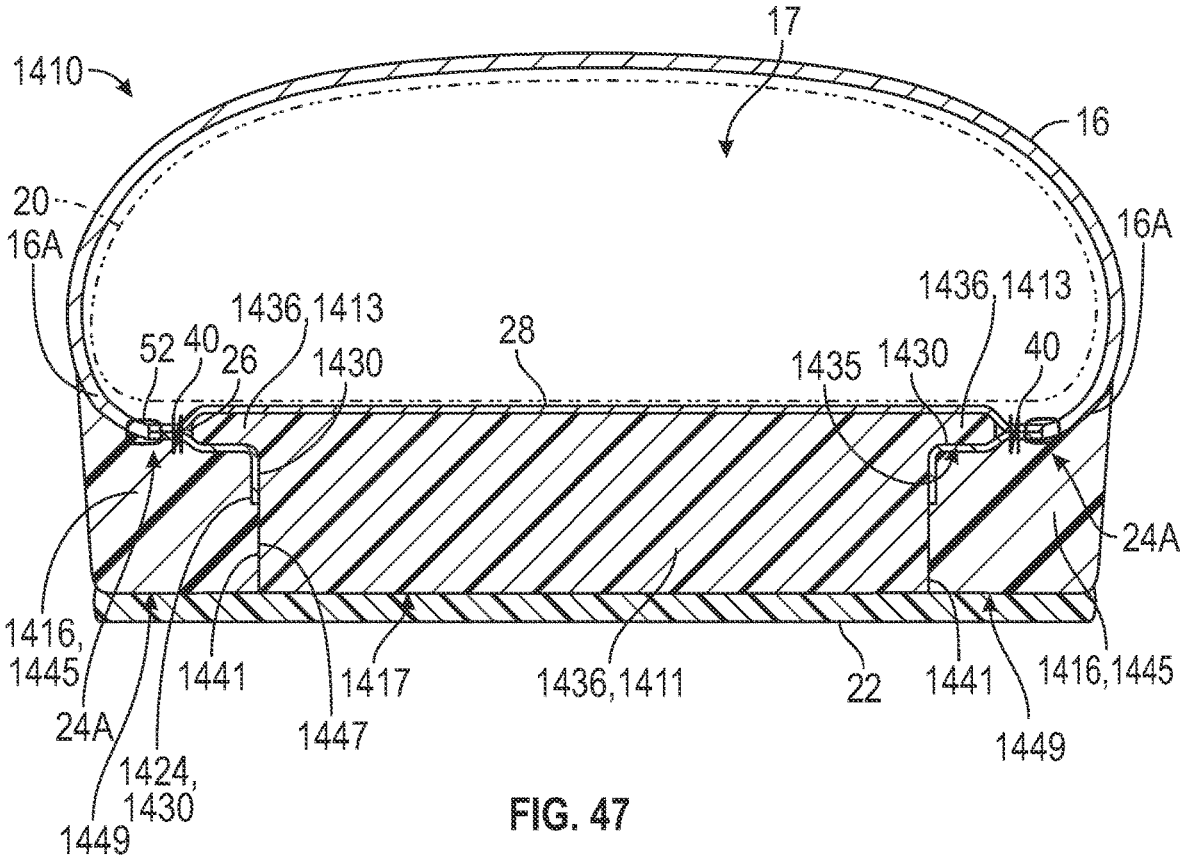
FIG. 47 is a cross-sectional illustration of an article of footwear including the strobel of FIG. 44 and the midsole of FIG. 45.

FIG. 45 shows a midsole 1416 including a foam carrier component 1445 to which the strobel 1412 is secured in the article of footwear 1410 of FIG. 47. The strobel 1412 is also secured at the peripheral flange 24A to the lower perimeter 16A of the upper 16. The midsole 1416 is configured as and includes the foam carrier component 1445, which may be a one-piece component. As shown in FIGS. 45 and 47, the foam carrier component 1445 has a central aperture 1447 configured as a through hole to receive the central portion 1411 of the cushioning member 1436 so that it fits to the strobel 1412 and is disposed below the bottom surface 1435 of the peripheral flange portion 1413 and is disposed outward of the outer wall 1441 of the central portion 1411. The central aperture 1447 may also be referred to as a recess in the foam carrier component 1445 of the midsole 1416. The bottom sheet 1430 is disposed between the peripheral flange portion 1413 and the foam carrier component 1445, and between an upper extent of the outer wall 1441 and the foam carrier component 1445. A lower extent of the foam carrier component 1445 is directly secured to the outer wall 1441 with adhesive and/or by thermal bonding (e.g., fusing).

The foam carrier component 1445 does not extend below the bottom surface 1417 of the central portion 1411. The central portion 1411 is configured to be the full height of the foam carrier component 1445 where it abuts the outer wall 1441. The central portion 1411, for example, has a height greater than the height of the central portion 1211 of FIG. 43, for example, which has the midsole 14 underlying it. With the bottom surface 1417 of the central portion 1411 not covered by the bottom sheet 1430, it is exposed so that the outsole 22 can be secured directly to the bottom surface 1417 of the central portion 1411 and to the bottom surface 1449 of the foam carrier component 1445. The outsole 22 may be at least partially transparent below the bottom surface 1417 of the central portion 1411 to expose the central portion 1411 to view through the outsole 22.

Accordingly, manufacturing the article of footwear 1410 is as described with respect to the article of footwear 10, and further includes extending the central portion 1411 of the unitary foam cushioning member 1436 through the central aperture 1431, securing the midsole 1416 (e.g., the foam carrier component 1445) to the outer wall 1441 of the central portion 1411 of the unitary foam cushioning member 1436 with the midsole 1416 disposed below the bottom surface 1435 of the peripheral flange portion 1413 of the unitary foam cushioning member 1436 and the central portion 1411 in the central aperture 1447. The midsole 1416 interfaces with and underlies the bottom surface 1417 of the central portion 1411 of the unitary foam cushioning member 1436. The method further comprises securing the outsole 22 to the bottom surface 1449 of the midsole 1416 and to a bottom surface 1417 of the central portion 1411 of the unitary foam cushioning member 1436.

Figure 48:
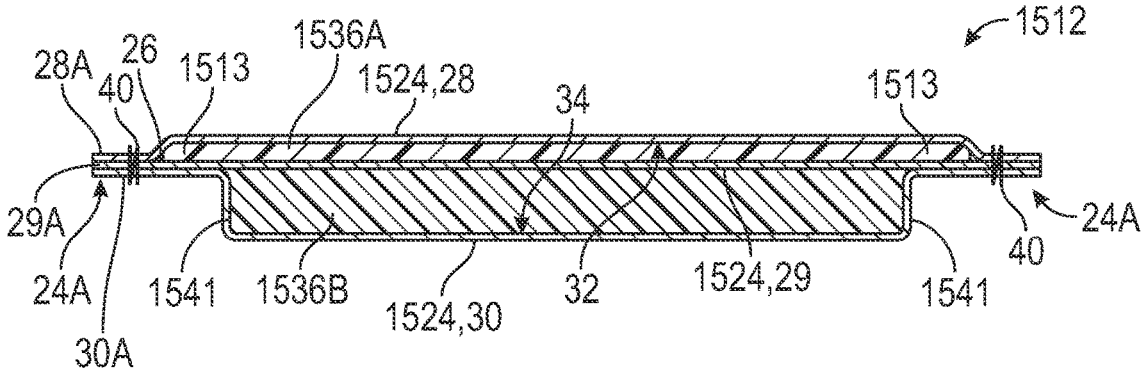
FIG. 48 is a cross-sectional illustration of another example of a strobel including a casing and a cushioning member.

FIG. 48 is another example of a strobel 1512. The strobel 1512 includes a casing 1524 that includes the top sheet 28, the bottom sheet 30, and an intermediate sheet 29 disposed between the top sheet 28 and the bottom sheet 30 at the peripheral flange 24A and extending across the cavity 26 defined between the inner surface 32 of the top sheet 28 and the inner surface 34 of the bottom sheet 30. The bottom sheet 30 has a periphery 30A secured to the periphery 28A of the top sheet 28 and to the periphery 29A of the intermediate sheet 29 by the first series of stitches 40 (e.g., by sewing) and/or by thermal bonding, welding, adhering, or compression molding. The peripheries 28A, 29A, 30A together define the peripheral flange 24A Like the top sheet 28 and the bottom sheet 30, the intermediate sheet 29 may include a polymeric material and/or a textile material.

The strobel 1512 includes a first cushioning member 1536A disposed between the top sheet 28 and the intermediate sheet 29, and a second cushioning member 1536B disposed between the intermediate sheet 29 and the bottom sheet 30. The first cushioning member 1536A is wider than the second cushioning member 1536B such that a peripheral portion 1513 of the first cushioning member 1536A is outward of an outer perimeter 1541 of the second cushioning member 1536B and inward of the peripheral flange 24A. Similar to cushioning members 236A and 236B, The first cushioning member 1536A and the second cushioning member 1536B may differ in at least one of material, hardness, energy return, or density. Alternatively, the cushioning members 1536A, 1536B could be identical in material, hardness, energy return, and density.

Forming the strobel 1512 includes arranging the first cushioning member 1536A and the second cushioning member 1536B so that the first cushioning member 1536A is disposed between the foot contact surface 18 of the strobel 1512 and the second cushioning member 1536B. Accordingly, forming the strobel 1512 includes interfitting the first cushioning member 1536A with the second cushioning member 1536B in the cavity 26 so that a first portion of an inner surface of the casing 1524 (e.g., the inner surface 32 of the top sheet 28) interfaces with the first cushioning member 1536A and a second portion of the inner surface of the casing 1524 (e.g., the inner surface 34 of the bottom sheet 30) interfaces with the second cushioning member 1536B.

Forming the strobel 1512 may include stacking the second cushioning member 1536B on the bottom sheet 30, stacking the intermediate sheet 29 on the second cushioning member 1536B, stacking the first cushioning member 1536A on the intermediate sheet 29, and then stacking the top sheet 28 on the first cushioning member 1536A before stitching the peripheral flange 24A. Alternatively, the assembly can be done in the reverse order, from the top sheet 28 to the bottom sheet 30, with the components inverted relative to their orientation on FIG. 48 for purposes of assembly. As assembled, the intermediate sheet 29 is disposed between the top sheet 28 and the bottom sheet 30, the first cushioning member 1536A is disposed between the top sheet 28 and the intermediate sheet 29, and the second cushioning member 1536B is disposed between the intermediate sheet 29 and the bottom sheet 30, with the periphery 30A of the bottom sheet 30, the periphery 29A of the intermediate sheet 29, and the periphery 28A of the top sheet 28 secured to one another to define the peripheral flange 24A, with the first cushioning member 1536A and the second cushioning member 1536B in cavity 26, the peripheral portion 1513 of the first cushioning member 1536A outward of the perimeter 1541 of the second cushioning member 1536B and inward of the peripheral flange 24A, and with the intermediate sheet 29 extending across the cavity 26.

Figure 49:
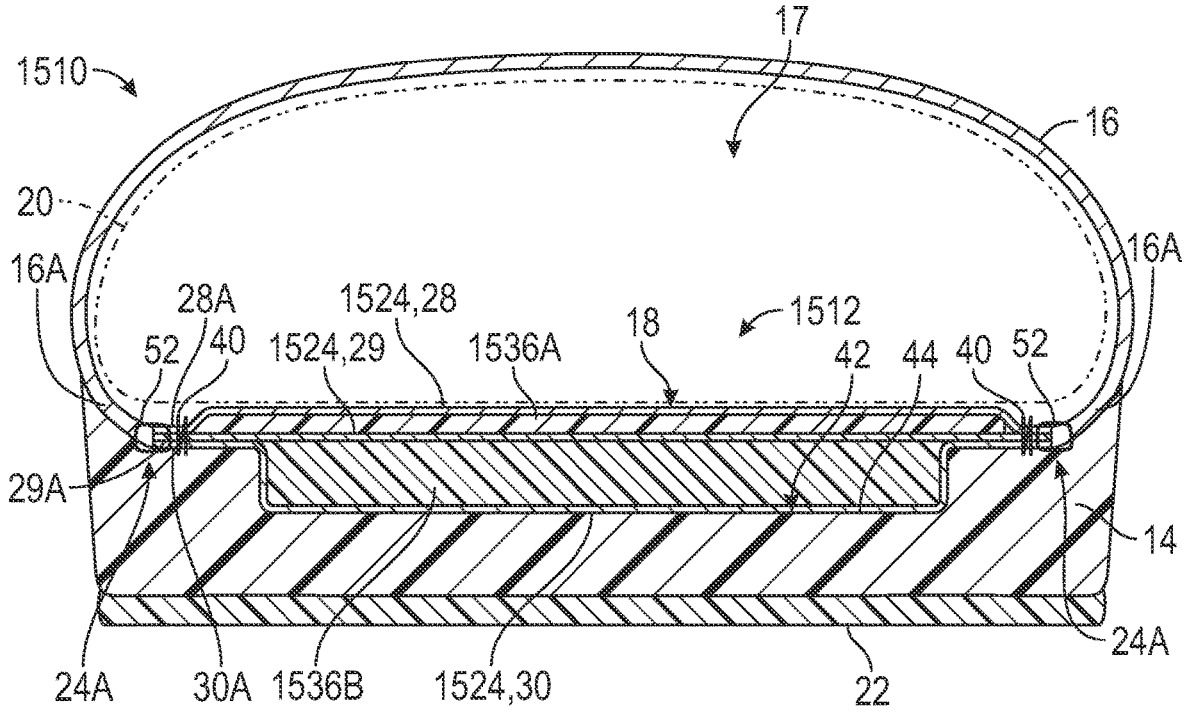
FIG. 49 is a cross-sectional illustration of an article of footwear including the strobel of FIG. 48.

FIG. 49 is a cross-sectional illustration of an article of footwear 1510 including the strobel 1512 of FIG. 48. The article of footwear 1510 is manufactured in the same manner as described with respect to the article of footwear 10 of FIG. 4, except using strobel 1512 instead of strobel 12. The exterior surface 18 of the top sheet 28 is the foot-contact surface within the void 17 as the article of footwear 1510 is characterized by the absence of an insole. The strobel 1512 rests on the upper surface 42 of the midsole 14 in the recess 44 such that at least a lower extent of the second cushioning member 1536B is disposed in the recess 44 and below the peripheral flange 24A. The cushioning members 1536A, 1536B are disposed entirely inward of the peripheral flange 24A and stitching 52 secures the peripheral flange 24A to the lower perimeter 16A of the upper 16, with the upper and lower sheets 28, 30 of the casing 24 in direct contact with one another at the peripheral flange 24A. The upper 16 and the strobel 1512 define the foot-receiving void 17 of the article of footwear 1310, with the exterior surface 18 of the casing 1524 being a foot contact surface of the strobel 1512.

Figure 50:
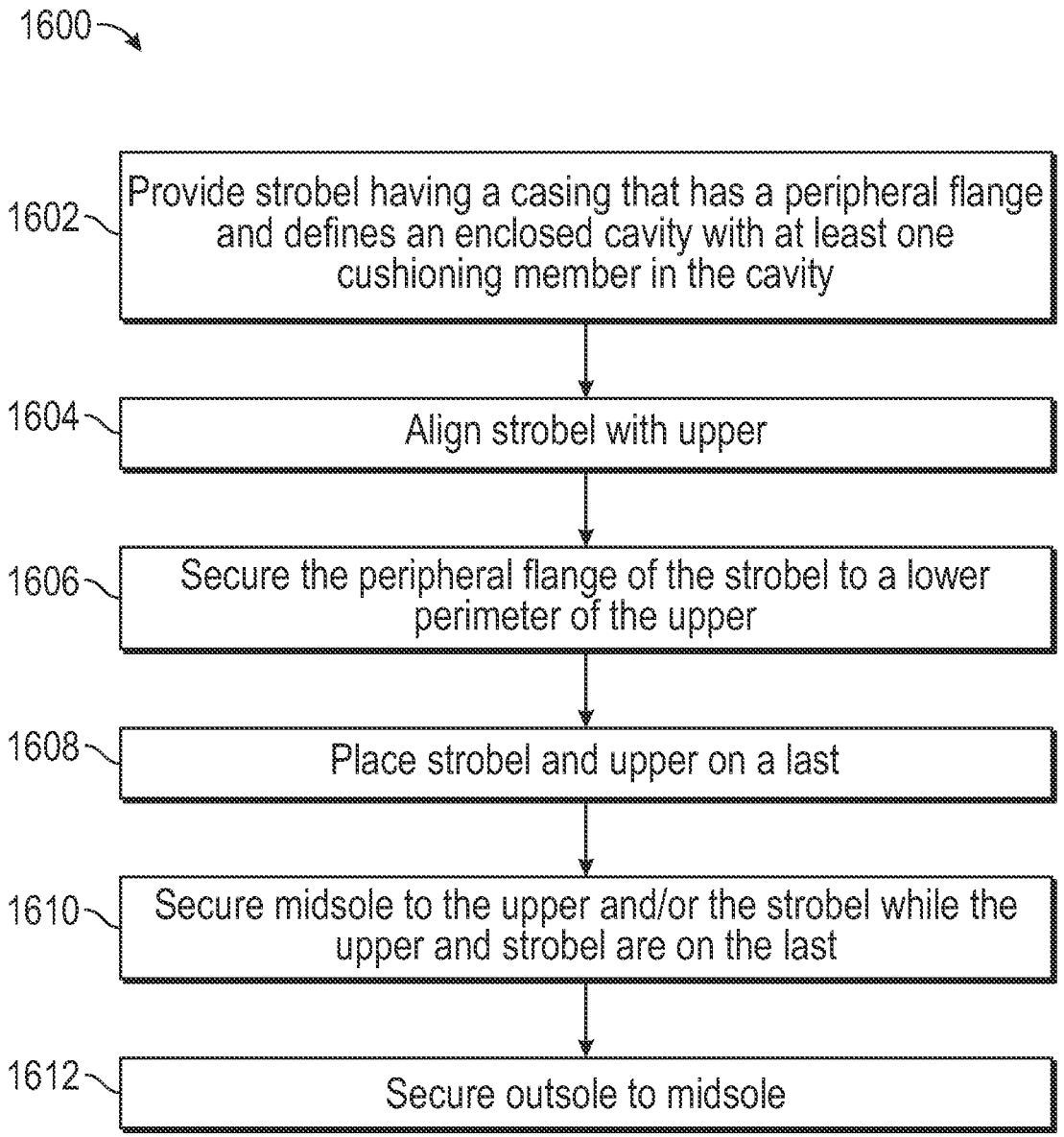
FIG. 50 is a flow diagram of a method of manufacturing an article of footwear.

FIG. 50 is a flow diagram of a method 1600 of manufacturing any of the articles of footwear discussed herein. The method 1600 includes step 1602, providing a strobel having a casing that has a peripheral flange and defines a cavity with at least one cushioning member in the cavity. Step 1602 applies to any of the strobels disclosed herein. For example, strobel 12 may be provided having the casing 24 with a peripheral flange 24A enclosing a cavity 26 with at least one cushioning member 36 in the cavity. In some examples, the strobel 12 that is provided may be formed by a separate entity than the entity carrying out the method 1600. In another example, the entity providing the strobel in step 1602 may be the same entity that forms the strobel, in which case forming the strobel may include one or more sub-steps of providing the strobel in step 1602. The different specific steps of forming each strobel have been discussed herein with respect to each strobel as described herein.

After the strobel is provided, it may be aligned with the upper 16 in step 1604 in preparation for securing the strobel to the upper 16. For example, in FIG. 9, the strobel 12 is being aligned with the upper 16 via locating features 51A, 51B, as described. Once aligned, the peripheral flange of the strobel may be secured to the lower perimeter 16A of the upper 16 in step 1606, as described with respect to peripheral flange 24A of strobel 12 being secured to the lower perimeter 16A by the stitching 52 in FIG. 10.

Next, in step 1608, the strobel with the upper secured thereto may be placed on a last, as shown, for example, with respect to the strobel 12 and upper 16 of FIG. 11 being placed on the last 54. In step 1610, the midsole may be secured to the upper and/or the strobel while the upper and strobel are on the last, as shown in FIG. 13, for example, with respect to the midsole 14 being adhered to the upper 16 (at the lower perimeter 16A) and to the strobel 12. In step 1612, the outsole 22 may then be secured to the midsole, as shown, for example with respect to outsole 22 secured to midsole 14 in FIG. 15. In all of the example strobels and articles of footwear discussed herein, the one or more cushioning members are disposed within the casing and at least a portion of the one or more cushioning members are nested in a recess 44 of the midsole so as to be disposed at least partially below the peripheral flange 24A.

The following are example configurations of strobels and articles of footwear, and example methods of manufacturing as disclosed herein.

Clause 1. A strobel for an article of footwear having an upper with a lower perimeter, the strobel comprising: a casing having a peripheral flange and defining a cavity; and at least one cushioning member disposed in the cavity; wherein an exterior surface of the casing facing away from the cavity is a foot contact surface of the strobel and the peripheral flange is configured for connection to the lower perimeter of the upper.

Clause 2. The strobel of clause 1, wherein the casing includes: a top sheet having a periphery; and a bottom sheet having a periphery secured to the periphery of the top sheet to define the peripheral flange, and the cavity defined between an inner surface of the top sheet and an inner surface of the bottom sheet; wherein each of the top sheet and the bottom sheet includes a polymeric material or a textile material.

Clause 3. The strobel of clause 2, wherein the top sheet is thermally bonded, welded, adhered, compression molded, or sewn to the bottom sheet at the peripheral flange.

Clause 4. The strobel of any of clauses 2-3, wherein the top sheet comprises a textile material and the bottom sheet comprises a thermoplastic polyurethane material, or the top sheet comprises a thermoplastic polyurethane material and the bottom sheet comprises a textile material, or both the top sheet and the bottom sheet comprise a textile material, or both the top sheet and the bottom sheet comprise a thermoplastic polyurethane material.

Clause 5. The strobel of any of clauses 1-4, wherein: the at least one cushioning member includes a first cushioning member and a second cushioning member; and at least a portion of the first cushioning member overlies the second cushioning member and is disposed between the foot contact surface of the strobel and the second cushioning member.

Clause 6. The strobel of clause 5, wherein the first cushioning member and the second cushioning member differ in at least one of material, hardness, energy return, or density.

Clause 7. The strobel of any of clauses 1-4, wherein: the at least one cushioning member includes a first cushioning member and a second cushioning member; and the first cushioning member interfits with the second cushioning member in the cavity so that a first portion of an inner surface of the casing interfaces with the first cushioning member and a second portion of the inner surface of the casing interfaces with the second cushioning member.

Clause 8. The strobel of clause 7, wherein the first cushioning member and the second cushioning member differ in at least one of material, hardness, energy return, or density.

Clause 9. The strobel of clause 8, wherein the first cushioning member and the second cushioning member interfit with one another such that both interface with a top inner surface of the casing.

Clause 10. The strobel of clause 9, wherein the first cushioning member partially overlies the second cushioning member in the cavity.

Clause 11. The strobel of any of clauses 1-4, wherein: at least a portion of a top surface of the at least one cushioning member interfacing with a top inner surface of the casing is convex; or at least a portion of the top surface of the at least one cushioning member interfacing with the top inner surface of the casing is concave.

Clause 12. The strobel of clause 1, wherein: the at least one cushioning member includes a first cushioning member and a second cushioning member; the first cushioning member is a foam cushioning member; and the second cushioning member is a fluid-filled chamber.

Clause 13. The strobel of clause 12, wherein at least a portion of the first cushioning member overlies the second cushioning member and is disposed between the foot contact surface of the casing and the second cushioning member.

Clause 14. The strobel of clause 13, further comprising: a plate disposed within the cavity between the first cushioning member and the second cushioning member.

Clause 15. The strobel of any of clauses 1-4, further comprising: a plate disposed within the cavity and overlying the at least one cushioning member so that the plate is between the foot contact surface of the strobel and the at least one cushioning member, and the at least one cushioning member is between the plate and a bottom exterior surface of the casing.

Clause 16. The strobel of any of clauses 1-4, wherein: the at least one cushioning member is a unitary foam cushioning member configured with a central portion and a peripheral flange portion surrounding and extending outward from the central portion; the central portion is thicker than the peripheral flange portion; and the peripheral flange portion is nearer to a top surface of the central portion than to a bottom surface of the central portion.

Clause 17. The strobel of clause 16, further comprising: stitching extending through the peripheral flange portion of the unitary foam cushioning member and the peripheral flange of the casing, the stitching joining the peripheral flange portion of the unitary foam cushioning member to the peripheral flange of the casing.

Clause 18. The strobel of any of clauses 16-17, wherein: the casing has a central aperture extending through a bottom of the casing; and the central portion of the foam cushioning member extends through the central aperture.

Clause 19. The strobel of clause 1, wherein the casing includes: a top sheet having a periphery; and a bottom sheet having a periphery secured to the periphery of the top sheet to define the peripheral flange, and the cavity defined between an inner surface of the top sheet and an inner surface of the bottom sheet; wherein each of the top sheet and the bottom sheet includes a polymeric material or a textile material; and the strobel further comprising: an intermediate sheet disposed between the top sheet and the bottom sheet at the peripheral flange and extending across the cavity; wherein the at least one cushioning member includes a first cushioning member disposed between the top sheet and the intermediate sheet, and a second cushioning member disposed between the intermediate sheet and the bottom sheet; and wherein the first cushioning member is wider than the second cushioning member such that a peripheral portion of the first cushioning member is outward of a perimeter of the second cushioning member and inward of the peripheral flange.

Clause 20. An article of footwear particularly according to any of the preceding clauses, the article of footwear comprising: an upper; a strobel including: a casing having a peripheral flange and defining a cavity; and at least one cushioning member disposed in the cavity; wherein a lower perimeter of the upper is secured to the peripheral flange of the strobel, the upper and the strobel defining a foot-receiving void of the article of footwear; and wherein an exterior surface of the casing facing away from the cavity is a foot contact surface of the strobel within the foot-receiving void, the article of footwear characterized by the absence of an insole.

Clause 21. The article of footwear of clause 20, further comprising: a midsole; wherein: the strobel at least partially overlies the midsole; an upper surface of the midsole defines a recess; and the strobel rests on the upper surface of the midsole in the recess such that at least a portion of the at least one cushioning member is disposed in the recess and below the peripheral flange.

Clause 22. The article of footwear of any of clauses 20-21, wherein the casing includes: a top sheet having a periphery; and a bottom sheet having a periphery secured to the periphery of the top sheet to define the peripheral flange, and the cavity defined between an inner surface of the top sheet and an inner surface of the bottom sheet; wherein each of the top sheet and the bottom sheet includes a polymeric material or a textile material.

Clause 23. The article of footwear of clause 22, wherein the top sheet is thermally bonded, welded, adhered, compression molded, or sewn to the bottom sheet at the peripheral flange.

Clause 24. The article of footwear of any of clauses 22-23, wherein the top sheet includes a textile material and the bottom sheet includes a thermoplastic polyurethane material, or the top sheet includes a thermoplastic polyurethane material and the bottom sheet includes a textile material, or both the top sheet and the bottom sheet include a textile material, or both the top sheet and the bottom sheet include a thermoplastic polyurethane material.

Clause 25. The article of footwear of clause 20, wherein: the at least one cushioning member includes a first cushioning member and a second cushioning member; and at least a portion of the first cushioning member overlies the second cushioning member and is disposed between the foot contact surface of the strobel and the second cushioning member.

Clause 26. The article of footwear of clause 25, wherein the first cushioning member and the second cushioning member differ in at least one of material, hardness, energy return, or density.

Clause 27. The article of footwear of clause 20, wherein: the at least one cushioning member includes a first cushioning member and a second cushioning member; and the first cushioning member interfits with the second cushioning member in the cavity so that a first portion of an inner surface of the casing interfaces with the first cushioning member and a second portion of the inner surface of the casing interfaces with the second cushioning member.

Clause 28. The article of footwear of clause 27, wherein the first cushioning member and the second cushioning member differ in at least one of material, hardness, energy return, or density.

Clause 29. The article of footwear of any of clauses 27-28, wherein the first cushioning member and the second cushioning member interfit with one another such that both interface with a top inner surface of the casing.

Clause 30. The article of footwear of clause 29, wherein the first cushioning member partially overlies the second cushioning member in the cavity.

Clause 31. The article of footwear of clause 20, wherein: at least a portion of a top surface of the at least one cushioning member interfacing with a top inner surface of the casing is convex; or at least a portion of the top the surface of the at least one cushioning member interfacing with the top inner surface of the casing is concave.

Clause 32. The article of footwear of clause 20, wherein: the at least one cushioning member includes a first cushioning member and a second cushioning member; the first cushioning member is a foam cushioning member; and the second cushioning member is a fluid-filled chamber.

Clause 33. The article of footwear of clause 32, wherein: at least a portion of the first cushioning member overlies the second cushioning member and is disposed between the foot contact surface of the casing and the second cushioning member.

Clause 34. The article of footwear of clause 33, further comprising: a plate disposed within the cavity between the first cushioning member and the second cushioning member.

Clause 35. The article of footwear of clause 20, further comprising: a plate disposed within the cavity and overlying the at least one cushioning member so that the plate is between the foot contact surface of the strobel and the at least one cushioning member, and the at least one cushioning member is between the plate and a bottom exterior surface of the casing.

Clause 36. The article of footwear of clause 20, wherein: the at least one cushioning member is a unitary foam cushioning member configured with a central portion and a peripheral flange portion surrounding and extending outward from the central portion; and the central portion is thicker than the peripheral flange portion; and the peripheral flange portion is nearer to a top surface of the central portion than to a bottom surface of the central portion.

Clause 37. The article of footwear of clause 36, further comprising: a first line of stitching extending through the peripheral flange portion of the unitary foam cushioning member and the peripheral flange of the casing, the stitching joining the peripheral flange portion of the unitary foam cushioning member to the peripheral flange of the casing; and a second line of stitching extending through the peripheral flange of the casing and the lower perimeter of the upper to secure the strobel to the upper, the second line of stitching disposed between a peripheral edge of the peripheral flange and the first line of stitching such that the second line of stitching is outward of the first line of stitching and not extending through the unitary foam cushioning member.

Clause 38. The article of footwear of clause 36, further comprising: a midsole, wherein: the strobel at least partially overlies the midsole; the casing has a central aperture extending through a bottom of the casing; the central portion of the foam cushioning member extends through the central aperture; and the midsole includes a foam carrier component disposed below a bottom surface of the peripheral flange portion of the foam cushioning member and disposed outward of an outer wall of the central portion of the foam cushioning member.

Clause 39. The article of footwear of clause 38, further comprising an outsole secured to a bottom surface of the foam carrier component and to a bottom surface of the central portion of the foam cushioning member.

Clause 40. The article of footwear of clause 39, wherein the outsole is at least partially transparent below the bottom surface of the central portion of the foam cushioning member.

Clause 41. The article of footwear of clause 36, wherein: the midsole includes a foam carrier component disposed below a bottom surface of the peripheral flange portion of the foam cushioning member and disposed outward of an outer wall of the central portion of the foam cushioning member; and the foam carrier component underlies a bottom surface of the central portion of the foam cushioning member.

Clause 42. The article of footwear of clause 41, further comprising an outsole secured to a bottom surface of the foam carrier component.

Clause 43. The article of footwear of clause 20, wherein the casing includes: a top sheet having a periphery; and a bottom sheet having a periphery secured to the periphery of the top sheet to define the peripheral flange, and the cavity defined between an inner surface of the top sheet and an inner surface of the bottom sheet; wherein each of the top sheet and the bottom sheet includes a polymeric material or a textile material; and the article of footwear further comprising: an intermediate sheet disposed between the top sheet and the bottom sheet at the peripheral flange and extending across the cavity; wherein the at least one cushioning member includes a first cushioning member disposed between the top sheet and the intermediate sheet, and a second cushioning member disposed between the intermediate sheet and the bottom sheet; and wherein the first cushioning member is wider than the second cushioning member such that a peripheral portion of the first cushioning member is outward of a perimeter of the second cushioning member and inward of the peripheral flange.

Clause 44. A method of manufacturing an article of footwear particularly according to any of the preceding clauses, the method comprising: securing a peripheral flange of a casing of a strobel to a lower perimeter of an upper, the upper and the strobel defining a foot-receiving void of the article of footwear, the strobel having at least one cushioning member, the casing defining a cavity, and the at least one cushioning member disposed in the cavity; and wherein an exterior surface of the casing facing away from the cavity is a foot contact surface of the strobel within the foot-receiving void, the article of footwear characterized by the absence of an insole.

Clause 45. The method of clause 44, further comprising: lasting the upper after securing the peripheral flange of the casing to the lower perimeter of the upper.

Clause 46. The method of clause 44, further comprising: securing an upper surface of a midsole to at least one of the upper or a lower exterior surface of the strobel such that at least a portion of the at least one cushioning member of the strobel rests in a recess in the upper surface of the midsole below the peripheral flange.

Clause 47. The method of any of clauses 44-46, wherein securing the peripheral flange to the lower perimeter of the upper is by stitching the peripheral flange to the lower perimeter of the upper.

Clause 48. The method of any of clauses 44-47, wherein the casing includes a top sheet having a periphery and a bottom sheet having a periphery; and the method further comprising: forming the strobel by: disposing the at least one cushioning member between the top sheet and the bottom sheet; and securing the periphery of the bottom sheet to the periphery of the top sheet to define the peripheral flange, and the cavity defined between an inner surface of the top sheet and an inner surface of the bottom sheet with the at least one cushioning member in the cavity.

Clause 49. The method of clause 48, wherein securing the periphery of the bottom sheet to the periphery of the top sheet to define the peripheral flange is by at least one of thermal bonding, welding, adhering, compression molding, or sewing.

Clause 50. The method of clause 48, wherein the at least one cushioning member includes a first cushioning member and a second cushioning member; wherein the first cushioning member and the second cushioning member differ in at least one of material, hardness, energy return, or density; and forming the strobel further includes: arranging the first cushioning member and the second cushioning member so that at least a portion of the first cushioning member is disposed between the foot contact surface of the strobel and the second cushioning member.

Clause 51. The method of clause 48, wherein the at least one cushioning member includes a first cushioning member and a second cushioning member; wherein the first cushioning member and the second cushioning member differ in at least one of material, hardness, energy return, or density; and forming the strobel further includes: interfitting the first cushioning member with the second cushioning member in the cavity so that a first portion of an inner surface of the casing interfaces with the first cushioning member and a second portion of the inner surface of the casing interfaces with the second cushioning member.

Clause 52. The method of clause 48, wherein forming the strobel further includes: disposing a plate within the cavity so that the plate is between the foot contact surface of the strobel and the at least one cushioning member, and the at least one cushioning member is between the plate and a bottom exterior surface of the casing Clause 53. The method of clause 48, wherein: the at least one cushioning member is a unitary foam cushioning member configured with a central portion and a peripheral flange portion surrounding and extending outward from the central portion; the central portion is thicker than the peripheral flange portion; and forming the strobel further includes: stitching the peripheral flange portion of the unitary foam cushioning member to the top sheet and the bottom sheet at the peripheral flange of the casing with the peripheral flange portion nearer to a top surface of the central portion than to a bottom surface of the central portion, the stitching joining the peripheral flange portion of the unitary foam cushioning member to the peripheral flange of the casing.

Clause 54. The method of clause 53, wherein the casing has a central aperture extending through a bottom sheet; and forming the strobel further includes: extending the central portion of the unitary foam cushioning member through the central aperture.

Clause 55. The method of clause 54, further comprising: securing a midsole to an outer wall of the central portion of the unitary foam cushioning member with the midsole disposed below a bottom surface of the peripheral flange portion of the unitary foam cushioning member.

Clause 56. The method of clause 55, wherein the midsole interfaces with and underlies the casing below a bottom surface of the central portion of the unitary foam cushioning member.

Clause 57. The method of clause 55, further comprising: securing an outsole to a bottom surface of the midsole.

Clause 58. The method of clause 55, further comprising: securing an outsole to a bottom surface of the midsole and to a bottom surface of the central portion of the unitary foam cushioning member.

Clause 59. The method of clause 58, wherein the outsole is at least partially transparent below the bottom surface of the central portion of the unitary foam cushioning member.

Clause 60. The method of clause 44, wherein the casing includes a top sheet having a periphery and a bottom sheet having a periphery; wherein the at least one cushioning member includes a first cushioning member and a second cushioning member; wherein the first cushioning member and the second cushioning member differ in at least one of material, hardness, energy return, or density; and forming the strobel further includes: disposing an intermediate sheet between the top sheet and the bottom sheet; disposing the first cushioning member between the top sheet and the intermediate sheet; disposing the second cushioning member between the intermediate sheet and the bottom sheet; and securing the periphery of the bottom sheet, a periphery of the intermediate sheet, and the periphery of the top sheet to one another to define the peripheral flange, and the cavity defined between an inner surface of the top sheet and an inner surface of the bottom sheet with the first cushioning member and the second cushioning member in cavity; wherein the first cushioning member is wider than the second cushioning member such that a peripheral portion of the first cushioning member is outward of a perimeter of the second cushioning member and inward of the peripheral flange; and wherein the intermediate sheet extends across the cavity.

To assist and clarify the description of various embodiments, various terms are defined herein. Unless otherwise indicated, the following definitions apply throughout this specification (including the claims). Additionally, all references referred to are incorporated herein in their entirety.

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" refers to a direction extending along a length of a component. For example, a longitudinal direction of a shoe extends between a forefoot region and a heel region of the shoe. The term "forward" or "anterior" is used to refer to the general direction from a heel region toward a forefoot region, and the term "rearward" or "posterior" is used to refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse" refers to a direction extending along a width of a component. For example, a transverse direction of a shoe extends between a lateral side and a medial side of the shoe. The transverse direction or axis may also be referred to as a lateral direction or axis or a mediolateral direction or axis.

The term "vertical" refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" refers to the vertical direction pointing towards a top of the component, which may include an instep, a fastening region and/or a throat of an upper. The term "downward" or "downwards" refers to the vertical direction pointing opposite the upwards direction, toward the bottom of a component and may generally point towards the bottom of a sole structure of an article of footwear.

The "interior" of an article of footwear, such as a shoe, refers to portions at the space that is occupied by a wearer's foot when the shoe is worn. The "inner side" of a component refers to the side or surface of the component that is (or will be) oriented toward the interior of the component or article of footwear in an assembled article of footwear. The "outer side" or "exterior" of a component refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" refer to the direction toward the interior of the component or article of footwear, such as a shoe, and the terms "outward" and "outwardly" refer to the direction toward the exterior of the component or article of footwear, such as the shoe. In addition, the term "proximal" refers to a direction that is nearer a center of a footwear component, or is closer toward a foot when the foot is inserted in the article of footwear as it is worn by a user. Likewise, the term "distal" refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. An article of footwear comprising:

an upper;

a strobel including a casing, the casing having a peripheral flange and defining a cavity; and a cushioning member disposed in the cavity;

wherein the casing includes:

a top sheet having a periphery; and a bottom sheet having a periphery secured to the periphery of the top sheet of the casing to define the peripheral flange of the casing, and the cavity defined between an inner surface of the top sheet of the casing and an inner surface of the bottom sheet of the casing;

wherein the periphery of the bottom sheet of the casing is secured to the periphery of the top sheet of the casing with stitching and without thermal bonds, welds, or adhesive to define the peripheral flange of the casing;

wherein the cushioning member is a fluid-filled chamber including a top sheet bonded to a bottom sheet at a cushioning member peripheral flange, the cushioning member peripheral flange entirely inward of the peripheral flange of the casing in the cavity;

wherein a lower perimeter of the upper is secured to the peripheral flange of the strobel, the upper and the strobel defining a foot-receiving void of the article of footwear; and wherein an exterior surface of the casing facing away from the cavity is a foot contact surface of the strobel within the foot-receiving void, the article of footwear characterized by the absence of an insole.

2. The article of footwear of claim 1, wherein at least one of the top sheet of the casing or the bottom sheet of the casing includes a textile material.

3. The article of footwear of claim 2, wherein both the top sheet of (Original) the casing and the bottom sheet of the casing comprise a textile material.

4. The article of footwear of claim 1, further comprising:

a midsole; wherein:

the strobel at least partially overlies the midsole;

an upper surface of the midsole defines a recess; and the strobel rests on the upper surface of the midsole in the recess such that at least a portion of the cushioning member is disposed in the recess and below the peripheral flange.

5. The article of footwear of claim 1, further comprising:

a plate disposed within the cavity and overlying the cushioning member so that the cushioning member is between the plate and a bottom exterior surface of the casing.

6. The article of footwear of claim 5, wherein the plate is less compressible than the cushioning member.

7. The article of footwear of claim 1, wherein the cushioning member is configured to provide resilient compressibility with energy return.

8. The article of footwear of claim 7, wherein the fluid-filled chamber is pressurized.

9. The article of footwear of claim 1, further comprising additional stitching extending through the peripheral flange and the lower perimeter of the upper to secure the strobel to the upper.

10. The article of footwear of claim 1, wherein the cushioning member is the only cushioning member disposed within the cavity of the casing.

11. A method of manufacturing an article of footwear, the method comprising:

forming a strobel by stitching a periphery of a top sheet of a casing of the strobel to a periphery of a bottom sheet of the casing of the strobel to define a peripheral flange of the casing; wherein the top sheet of the casing is secured to the bottom sheet of the casing at the peripheral flange by the stitching and without thermal bonds, welds, or adhesive; and securing the peripheral flange of the casing of the strobel to a lower perimeter of an upper, the upper and the strobel defining a foot-receiving void of the article of footwear, the strobel having a cushioning member, the casing defining a cavity, and the cushioning member disposed in the cavity;

wherein the cushioning member is a fluid-filled chamber including a top sheet bonded to a bottom sheet at a cushioning member peripheral flange, the cushioning member peripheral flange entirely inward of the peripheral flange of the casing in the cavity; and wherein an exterior surface of the casing facing away from the cavity is a foot contact surface of the strobel within the foot-receiving void, the article of footwear characterized by the absence of an insole.

12. The method of manufacturing of claim 11, further comprising:

lasting the upper after securing the peripheral flange of the casing of the strobel to the lower perimeter of the upper.

13. The method of manufacturing of claim 11, further comprising:

securing an upper surface of a midsole to at least one of the upper or a lower exterior surface of the strobel such that at least a portion of the cushioning member of the strobel rests in a recess in the upper surface of the midsole below the peripheral flange of the casing.

14. The method of manufacturing of claim 11, wherein securing the peripheral flange of the casing of the strobel to the lower perimeter of the upper is by stitching the peripheral flange of the casing to the lower perimeter of the upper.

15. The method of manufacturing of claim 11, wherein forming the strobel further includes:

disposing a plate within the cavity so that the plate overlies the cushioning member and the cushioning member is between the plate and a bottom exterior surface of the casing.

16. The method of manufacturing of claim 15, wherein the plate is less compressible than the cushioning member.

17. The method of manufacturing of claim 11, further comprising:

inflating the fluid-filled chamber to pressurize the cushioning member.

18. The method of manufacturing of claim 11, wherein at least one of the top sheet of the casing or the bottom sheet of the casing includes a textile material.

19. The method of manufacturing of claim 11, wherein both the top sheet of the casing and the bottom sheet of the casing comprise a textile material.

20. The method of manufacturing of claim 11, wherein the cushioning member is the only cushioning member disposed within the cavity of the casing.

* * * * *